US007503473B2

(12) United States Patent
Niblett et al.

(10) Patent No.: US 7,503,473 B2
(45) Date of Patent: Mar. 17, 2009

(54) PNEUMATIC FASTENER

(75) Inventors: James R. Niblett, Columbia, MD (US); C. Kerwin Braddock, Bel Air, MD (US); Glen V. Steinbrunner, Forest Hill, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/657,902

(22) Filed: Jan. 25, 2007

(65) Prior Publication Data

US 2007/0257079 A1 Nov. 8, 2007

Related U.S. Application Data

(63) Continuation-in-part of application No. 11/063,646, filed on Feb. 22, 2005, now Pat. No. 7,278,561.

(60) Provisional application No. 60/546,685, filed on Feb. 20, 2004.

(51) Int. Cl.
*B25C 1/04* (2006.01)

(52) U.S. Cl. ..... 227/130; 227/10

(58) Field of Classification Search ..... 227/1, 227/10, 15, 6, 130, 8; 277/361, 394, 572
See application file for complete search history.

(56) References Cited

U.S. PATENT DOCUMENTS 3,896,840 A 7/1975 Anderson
4,401,251 A * 8/1983 Nikolich ..... 227/130
4,480,528 A 11/1984 Shiroyama
4,986,164 A * 1/1991 Crutcher ..... 91/461
5,476,205 A * 12/1995 Canlas et al. ..... 227/130
5,671,880 A * 9/1997 Ronconi ..... 227/130
5,706,996 A * 1/1998 Lee ..... 227/130
5,725,142 A * 3/1998 Hamada ..... 227/130
6,006,704 A * 12/1999 Phillips et al. ..... 123/46 SC
6,016,945 A * 1/2000 Phillips et al. ..... 227/10
6,016,946 A * 1/2000 Phillips et al. ..... 227/10
6,019,072 A * 2/2000 Phillips et al. ..... 123/46 H
6,079,605 A * 6/2000 Braun et al. ..... 227/130
6,095,392 A * 8/2000 Batts et al. ..... 227/8
6,145,727 A * 11/2000 Mukoyama et al. ..... 227/130

(Continued)

OTHER PUBLICATIONS

Search Report—European Patent Office for related application EP08100662.

*Primary Examiner*—Brian D Nash
(74) *Attorney, Agent, or Firm*—Rhonda L. Barton; Scott B. Markow

(57) ABSTRACT

A pneumatic fastener includes a housing and a handle coupled to the housing. The handle defines an inlet channel for delivering compressed gas to the housing. A trigger valve is in communication with the inlet channel and configured to actuate the pneumatic fastener. A fastener driving assembly is disposed within the housing. The fastener driving assembly includes a cylinder and a piston that reciprocates within the cylinder to drive a fastener. A valve piston is coupled to the fastener driving assembly. Actuation of the valve piston causes compressed air to drive the piston within the cylinder to drive the fastener. An outer cap is coupled to the housing and an inner cap is disposed at least partially within the outer cap. The inner cap includes an opening in communication with the trigger valve for porting the compressed air to a region above the valve piston.

24 Claims, 21 Drawing Sheets

U.S. PATENT DOCUMENTS 6,173,963 B1 * 1/2001 Ho et al. ..... 277/361
6,220,496 B1 * 4/2001 Hirai et al. ..... 227/130
6,431,046 B1 * 8/2002 Okpokowuruk ..... 91/308
6,443,348 B2 * 9/2002 Lamb ..... 227/8
6,626,081 B2 * 9/2003 Ho et al. ..... 91/394
6,648,202 B2 * 11/2003 Miller et al. ..... 227/130
6,854,631 B2 * 2/2005 Burke et al. ..... 227/130
2002/0104868 A1 * 8/2002 Miller et al. ..... 227/130
2002/0125290 A1 * 9/2002 Robinson ..... 227/8
2004/0031839 A1 * 2/2004 Pruyne ..... 227/130
2005/0189392 A1 9/2005 Schnell
2005/0247750 A1 * 11/2005 Burkholder et al. ..... 227/130

* cited by examiner

PNEUMATIC FASTENER

CROSS REFERENCE TO RELATED APPLICATIONS

The present application is co-pending and commonly assigned with U.S. patent application Ser. No. 11/063,646, filed Feb. 22, 2005, titled "Oil Free Head Valve for Pneumatic Nailers and Staplers," now U.S. Pat. No. 7,278,561, which application claims the benefit under 35 U.S.C. § 119(e) of U.S. Provisional Patent Application Ser. No. 60/546,685, entitled "Oil Free Head Valve for Pneumatic Nailers and Staplers," filed Feb. 20, 2004. Each of the foregoing applications is incorporated by reference in its entirety.

FIELD OF THE INVENTION

The present invention generally relates to the field of power tools, and particularly to a pneumatic fasteners, such as pneumatic nailers and staplers.

BACKGROUND OF THE INVENTION

Pneumatic power tools are commonly employed in a variety of work places in order to accomplish various tasks. Typical pneumatic power tools include pneumatic fasteners, such as pneumatic nailers and pneumatic staplers. A typical system within a pneumatic fastener generates the desired hammering force by employing compressed air (typically supplied by a separate air compressor), a valve assembly including a valve plunger, and a piston assembly including a sliding piston that drives a long blade. In such system, the piston is forced downward when the air pressure above the piston head is greater than below it. Moreover, the piston is forced into an "up" position when the air pressure below the piston is greater than above it. In addition, a trigger assembly is employed to allow a user to control the actuation of the pneumatic fastener.

In use, the pneumatic fastener is actuated by a user activating the trigger assembly. Upon actuation, the trigger assembly closes the trigger valve while opening a passageway to the atmosphere as such compressed air is prevented from flowing above the valve plunger whereby pressure beneath the plunger is greater than pressure above the plunger. This configuration causes the valve plunger to rise up and compressed air to travel to the piston head. The piston and the blade are then driven downward by the compressed air causing a fastener (e.g. a nail or staple) to be propelled from the chamber. The downward sliding of the piston, in turn, channels the air inside the cylinder through a series of holes into a return air chamber. When a user then releases the trigger assembly, the plunger is pushed back into place by the compressed air and air flow to the piston head is blocked. In the absence of downward pressure, the piston head is also pushed back up by the compressed air in the return air chamber. As a result, the air above the piston head is forced out of the gun and into the atmosphere.

SUMMARY OF THE INVENTION

In an aspect, a pneumatic fastener includes a housing and a handle coupled to the housing. The handle defines an inlet channel for delivering compressed gas to the housing. A trigger valve is in communication with the inlet channel and configured to actuate the pneumatic fastener. A fastener driving assembly is disposed within the housing. The fastener driving assembly includes a cylinder and a piston that reciprocates within the cylinder to drive a fastener. A valve piston is coupled to the fastener driving assembly. Actuation of the valve piston causes compressed air to drive the piston within the cylinder to drive the fastener. An outer cap is coupled to the housing and an inner cap is disposed at least partially within the outer cap. The inner cap includes an opening in communication with the trigger valve for porting the compressed air to a region above the valve piston.

Implementations of this aspect may include one or more of the following features. The opening may also port the compressed air from the region above the valve piston to the trigger valve upon actuation of the trigger valve. The inner cap may include a sidewall. The opening may include a plurality of openings in the sidewall. The sidewall may include a generally cylindrical sidewall. The inner cap may be seated in the outer cap with a space between the inner cap and the outer cap, the space being in communication with the inlet channel. The opening may be in communication with the space. The space also may be in communication with the trigger valve. The inner cap further may include a central opening configured to transmit exhaust air from the cylinder to an exhaust channel. The exhaust channel may be at least partially disposed in the handle. At least a portion of the inlet channel and at least a portion of the exhaust channel may be defined in the outer cap. The inner cap and the valve piston may be composed of materials that are configured to reduce lubrication needed for movement of the valve piston. The inner cap and the valve piston may be composed of materials that are configured to have approximately the same degree of thermal expansion. At least one of the inner cap and the valve piston may include a lubricious plastic.

In another aspect, a pneumatic fastener includes a housing and a handle coupled to the housing. The handle defines an inlet channel for delivering compressed gas to the housing. A trigger valve is in communication with the inlet channel and configured to actuate the pneumatic fastener. A fastener driving assembly is disposed within the housing. The fastener driving assembly includes a cylinder and a piston that reciprocates within the cylinder to drive a fastener. A valve piston is coupled to the fastener driving assembly, wherein actuation of the valve piston causes compressed air to drive the piston within the cylinder to drive the fastener. An outer cap is coupled to the housing. An inner cap is disposed at least partially within the outer cap and slidably receives the piston. The inner cap and the valve piston are composed of materials that are configured to reduce lubrication needed for movement of the valve piston.

Implementations of this aspect may include one or more of the following features. The inner cap and the valve piston may be composed of materials that are configured to have approximately the same degree of thermal expansion. The inner cap and/or the valve piston may include a lubricious plastic.

In another aspect, a pneumatic fastener includes a housing, a nosepiece coupled to the housing, a magazine coupled to one of the nosepiece and the housing and configured to store a plurality of fasteners, a driver disposed in the nosepiece for driving a fastener that has been dispensed from the magazine into a workpiece, a trigger coupled to the housing and configured to actuate the driver to drive the fastener, and a fastener driving assembly disposed within the housing. The fastener driving assembly includes a cylinder and a piston that reciprocates within the cylinder in response to application of compressed gas to drive the driver. A valve piston is coupled to the fastener driving assembly. Actuation of the valve piston causes the compressed gas to drive the piston within the cylinder to drive the fastener. A handle has a first end portion coupled to the housing and a second end portion coupled to the magazine. The second end portion includes an inlet connection for coupling the pneumatic fastener to a source of the compressed gas. An inlet channel extends through the handle from the inlet connection to the housing to deliver the compressed gas from the inlet connection to the housing. A trigger valve is in communication with the inlet channel and configured to actuate the pneumatic fastener. An outer cap is coupled to the housing and an inner cap is disposed between the outer cap and the valve piston. The inner cap includes a generally cylindrical sidewall that defines an axial opening configured to transmit exhaust air from the cylinder to an exhaust channel, and defines at least one radial opening configured to port compressed gas from the trigger valve to a region above the valve piston before actuation of the trigger and to port compressed gas from the region above the valve piston to the trigger valve upon actuation of the trigger. In an exemplary implementation of this aspect, the inner cap and the valve piston are composed of materials that are configured to reduce lubrication needed for movement of the valve piston.

Advantages may include one or more of the following. These features, taken singly or in combination, may reduce or eliminate the amount of lubricant required for the valve piston, may decrease manufacturing costs, and may extend the service life for the pneumatic fastener. These and other advantages and features will be apparent from the description, the drawings, and the claims.

DETAILED DESCRIPTION OF THE DRAWINGS

Figure 1:
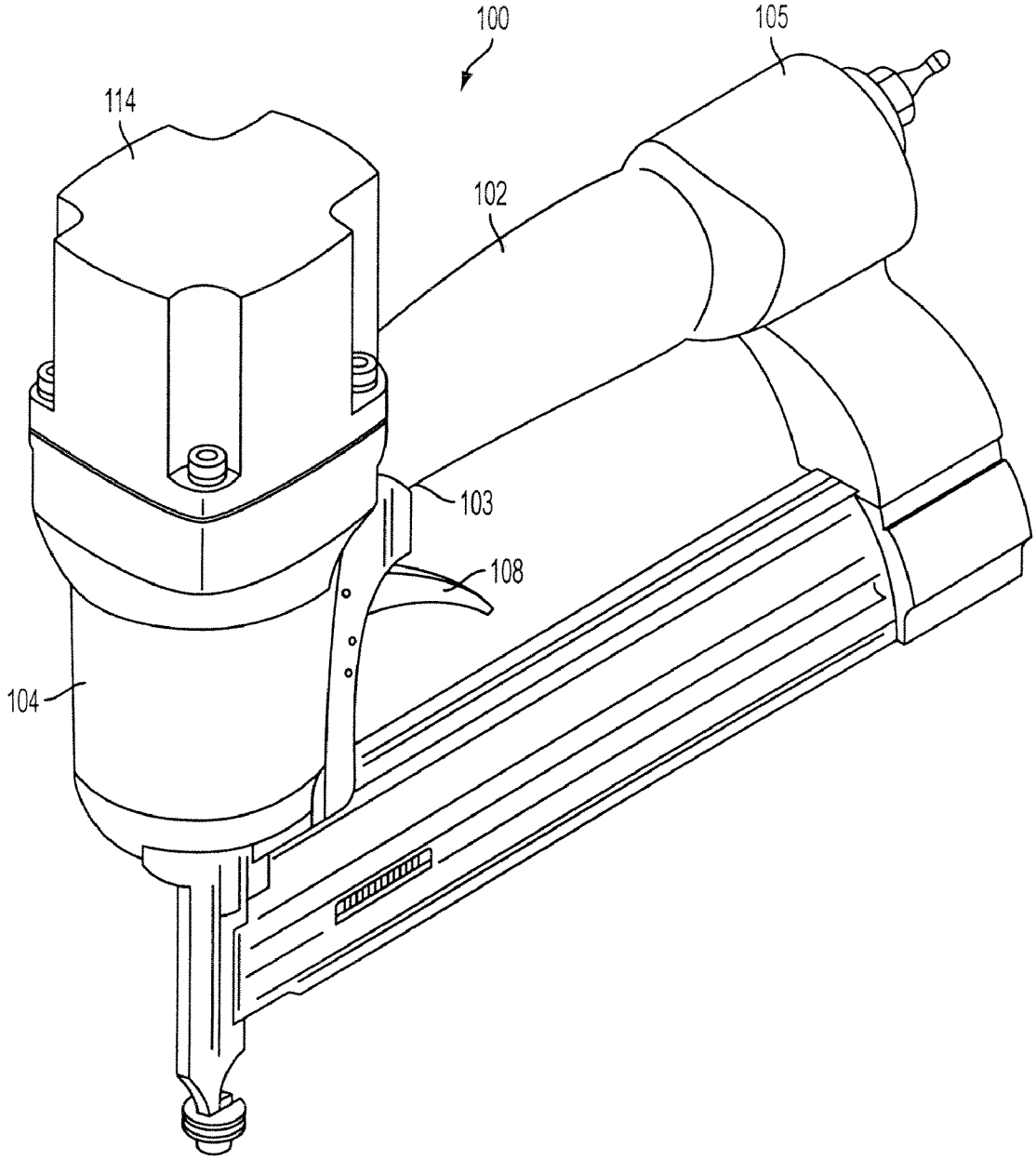
FIG. 1 is an illustration of an embodiment of a pneumatic fastener.

Referring to FIG. 1, an exemplary embodiment of a pneumatic fastener 100 includes a handle 102 having a first end 103 and a second end 105. A housing 104 is coupled with the first end 103 of the handle 102. The handle 102 further includes a handle adapter 156, which enables the coupling of a compressed air supply to the pneumatic fastener 100. In addition, a trigger assembly 108 for controlling the firing of the pneumatic fastener 100 may be coupled with the handle 102, proximal to the first end 103.

Figure 2:
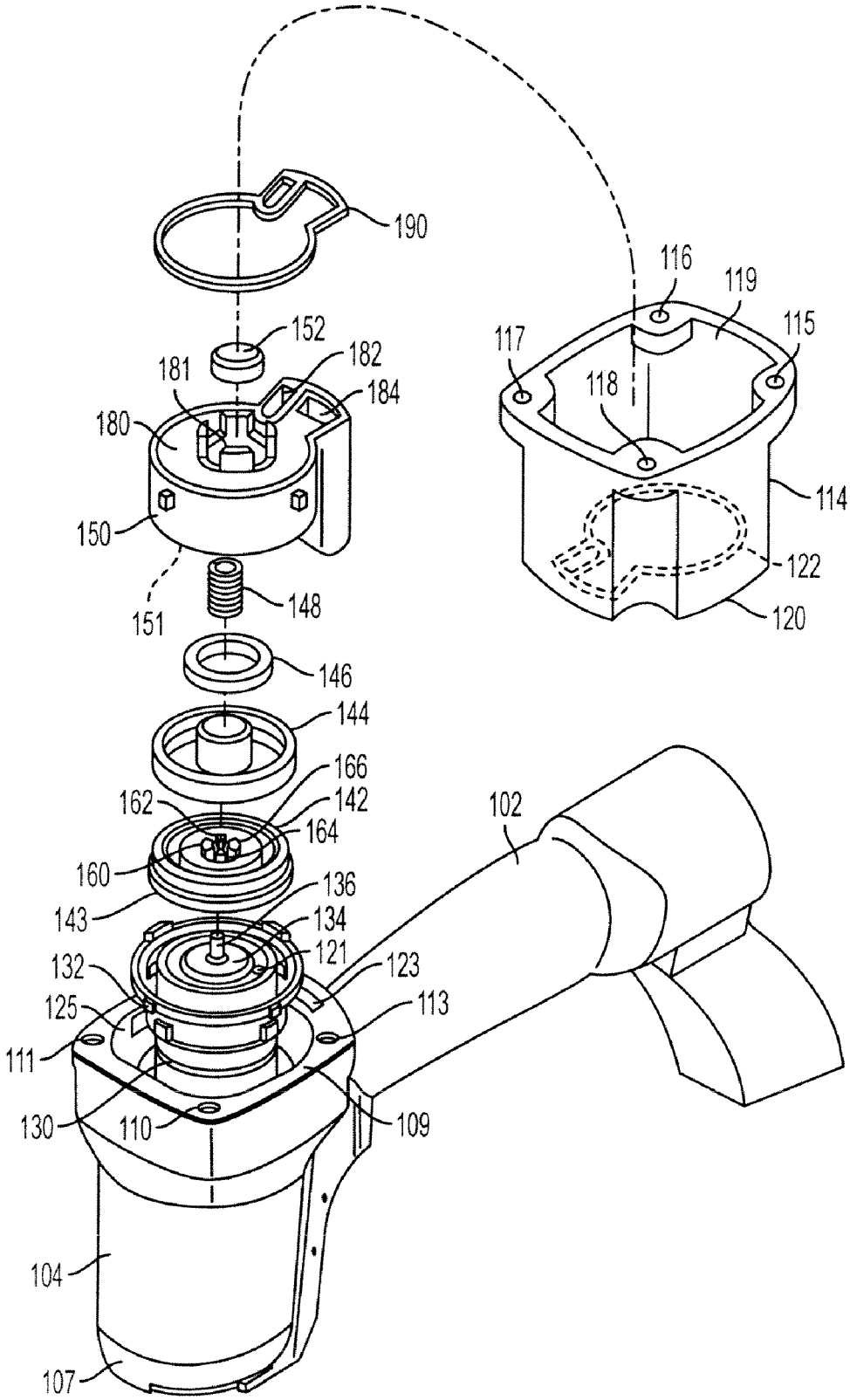
FIG. 2 is an exploded view of the pneumatic fastener of FIG. 1 including an exemplary embodiment of a head valve assembly coupled with a piston assembly.

Referring to FIG. 2, housing 104 defines a housing recessed area 125 within which a piston assembly including a cylinder 130 and a piston 134 may be mounted. The cylinder 130 is slidably coupled with the piston 134 which includes a piston projection 136. It is understood that the piston 134 may operationally engage a driver blade for driving a fastener by providing force to the driver blade. The piston projection 136 has a generally cylindrical shape. Alternatively, the piston projection 136 may be configured in various shapes, such as rectangular, spherical, and the like.

Housing 104 includes a first end 107 and a second end 109. The first end of the housing 107 may couple with various mechanical devices to enable the functionality of the nailer, such as a nose casting assembly, which may enable the operation of the driver blade. The second end 109 of the housing 104 includes a first housing fastening point 110, a second housing fastening 111, a third housing fastening point 112, and a fourth housing fastening point 113. The fastening points 110-113 allow the coupling of an outer cap 114 with the second end 109 of the housing 104. It is understood that the outer cap 114 may be composed of various materials, such as aluminum, steel, plastic, and the like. The fastening points may enable the use of a variety of fasteners. Suitable fasteners may include a screw, bolt, clip, pin, and the like. In the current embodiment, the cap 114 includes a first cap fastening point 115, a second cap fastening point 116, a third cap fastening point 117, and a fourth cap fastening point 118. The cap fastening points 115-118 align with the housing fastening points 110-113 to enable the fasteners to engage with the housing 104 and the cap 114 thereby securely affixing their position relative to one another.

Figure 6:
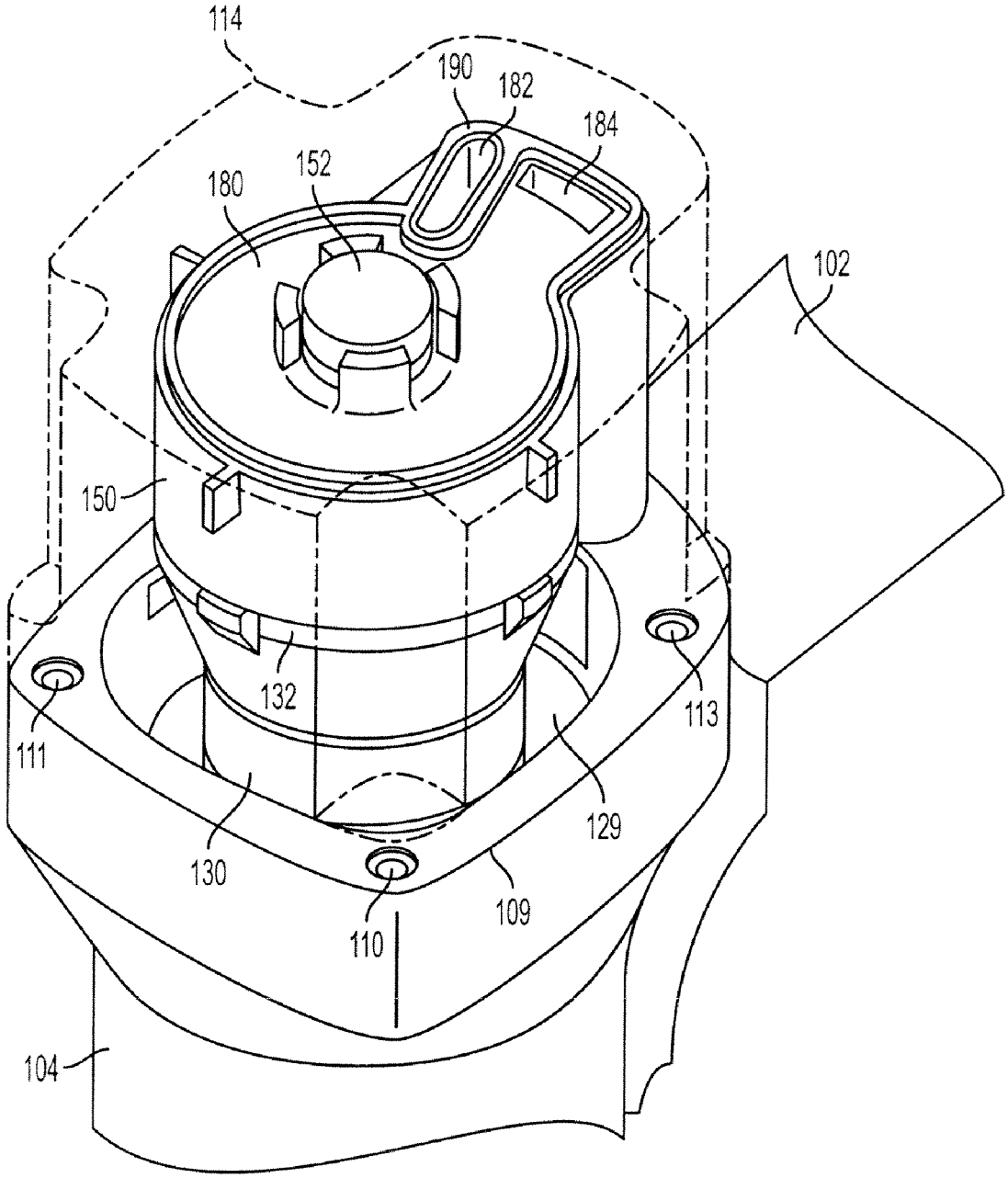
FIG. 6 is an isometric illustration of the head valve assembly of FIG. 2 coupled with a housing and a cap of the pneumatic fastener, wherein the head valve assembly at least partially occupies a fully defined recessed area of the pneumatic fastener.
Figure 7:
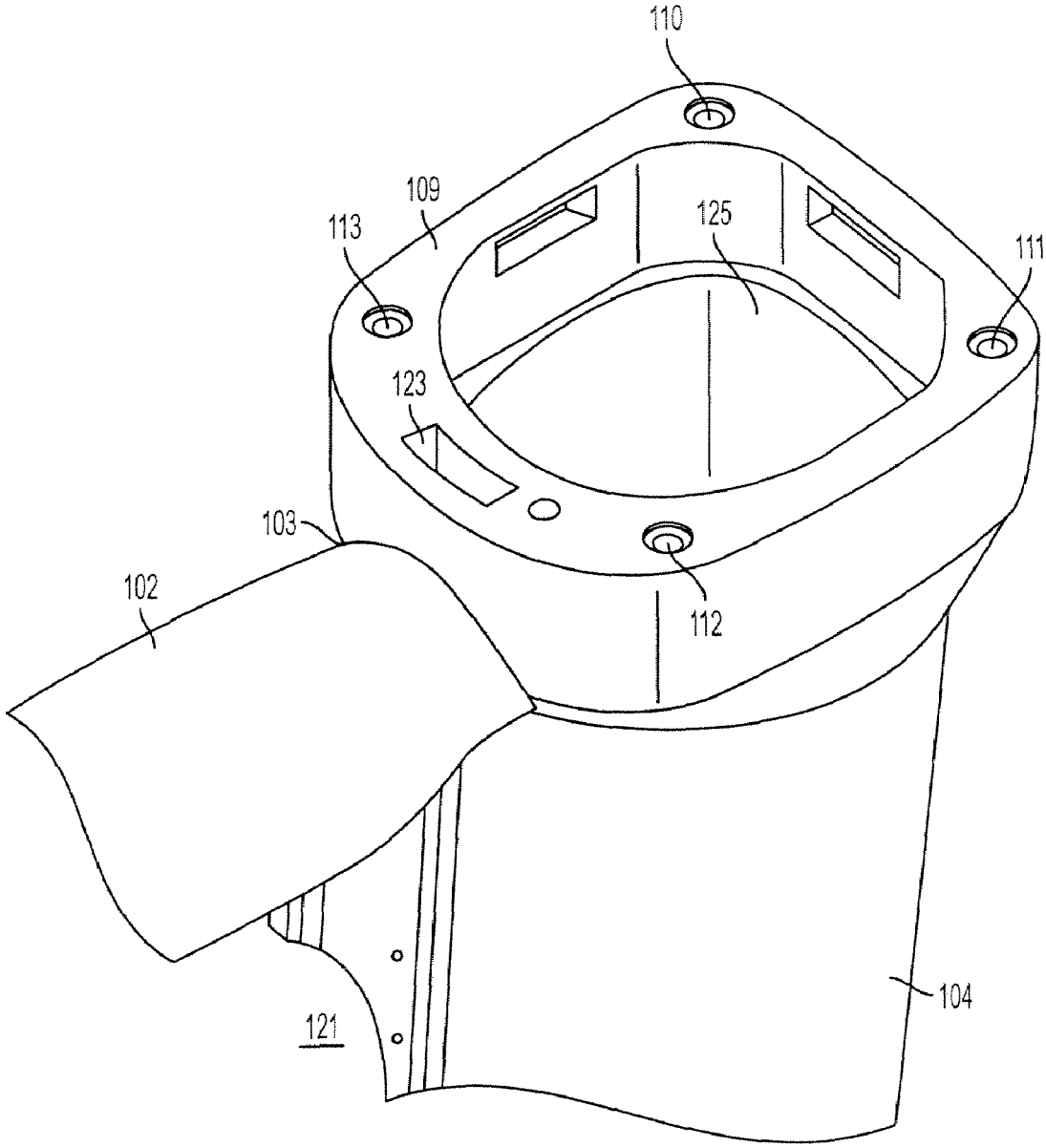
FIG. 7 is an isometric illustration of the housing of FIG. 1 including a housing inlet port and a housing outlet port.

The housing recessed area 125 is defined on one end by the first end 107 of the housing 104 and on the other end by the second end 109 of the housing 104. The cap 114 further defines an outer cap recessed area 119. When the cap 114 is coupled with the housing 104, a fully defined recessed area 129 (as illustrated in FIG. 6), of the pneumatic fastener 100 is established. It is understood that various configurations of the housing 104 and the cap 114 may define variously configured recessed areas 129. It is contemplated that the configurations of the housing 104 and the cap 114 may partially encompass the recessed area 129. Further, the housing 104 and the cap 114 may be configured for aesthetic and/or functional purposes. For example, contouring may provide the housing 104 and the cap 114 may provide for increased functionality by providing a contoured grip region. Still further, grip regions may be established with material for grasping engagement by the hand of the user of the pneumatic fastener 100, including soft grips and the like.

Referring to FIG. 2, the housing 104 further defines an inlet (supply) port 121 and an outlet (exhaust) port 123. The configuration of the housing inlet port 121 and the housing outlet port 123 may vary. In an embodiment, the housing inlet port 121 is of a generally cylindrically shaped conduit extending through the housing 104 while the housing outlet port 123 is of a generally rectangular shaped conduit extending through the housing 104. It is understood that the shape and/or configuration of the housing inlet and outlet ports may be varied as contemplated by those of ordinary skill in the art. For instance, the diameter of the housing inlet port 121 may be increased or decreased to alter the characteristics of the supply pressure.

Figure 3:
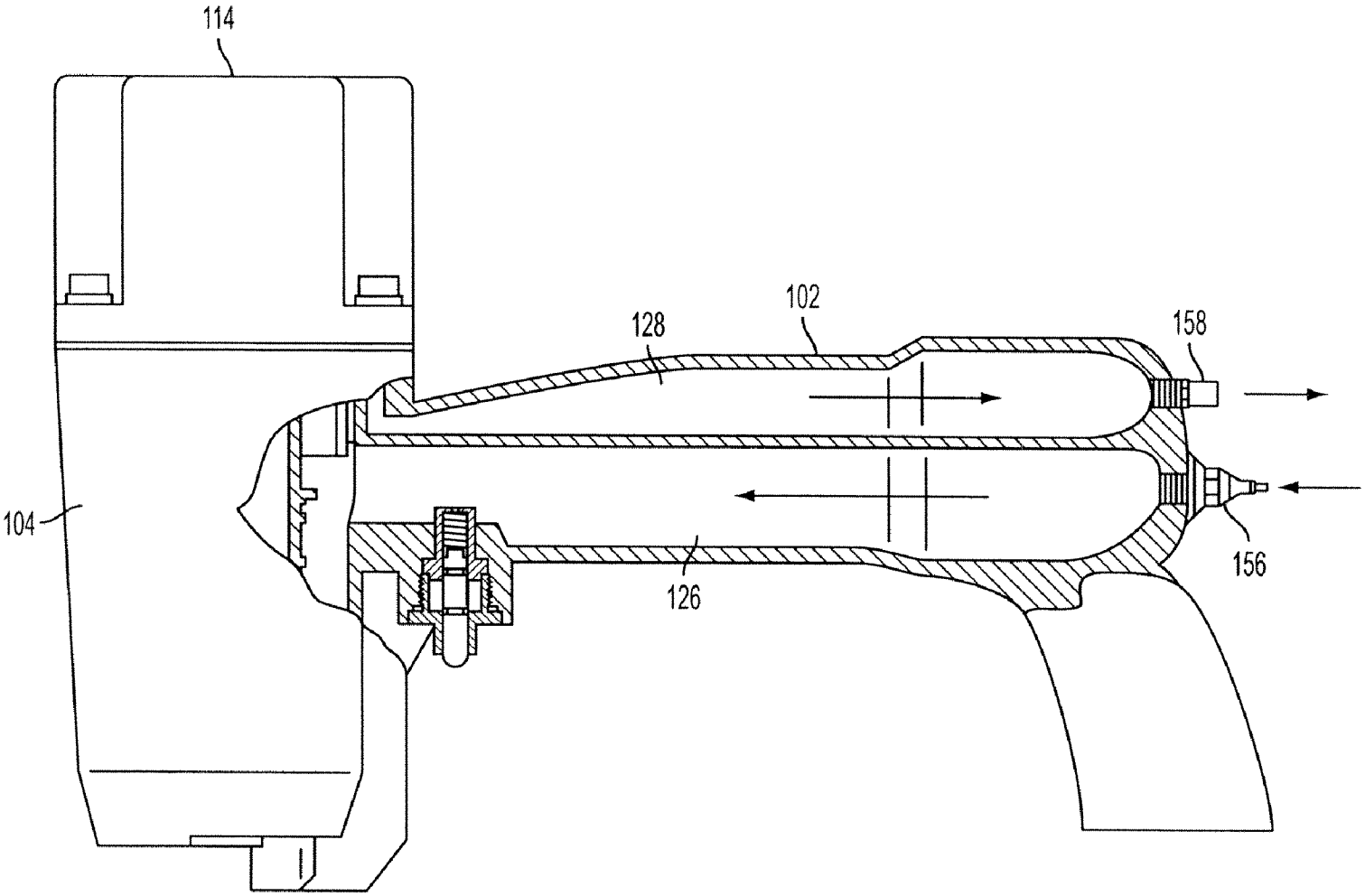
FIG. 3 is a cut away view of a handle of the pneumatic fastener of FIG. 1 including a handle adapter coupled with an inlet channel and an exhaust channel coupled with a handle exhaust.

Referring to FIG. 3, the housing inlet port 121 acts as a conduit for the supply of compressed air coming through the inlet channel 126 via the handle adapter 156 connection. In addition, the housing outlet port 123 acts as a conduit for the air exhausted after the firing of the pneumatic fastener, directing the exhaust to the outlet channel 128 and then through a handle exhaust 158 of the handle 102.

Referring again to FIG. 2, the pneumatic fastener 100 includes a head valve assembly with an inner cap 150 for directing the flow of air to and from the piston 134 of the piston assembly of the fastener 100. A basket 132 is included within the inner cap 150 for stabilizing the piston 134. In an alternative embodiment, the basket 132 is not included within the inner cap 150, but directly seated upon the cylinder 130.

The head valve assembly at least partially occupies the recessed area 129. Further, a main seal 142 is adjustably coupled with an inner diameter 151 of the inner cap 150. The main seal 142 is further coupled with the piston 134 and a valve piston 144. The main seal 142 is seated upon the piston 134. This coupling allows the main seal 142 to provide shock-absorption to the piston 134 of the pneumatic fastener 100. The main seal 142, in an exemplary embodiment, may be composed of a urethane material. Alternative materials, such as other plastics, metals, and the like, may be employed as contemplated by those of skill in the art which include the desired durability. Additionally, in an embodiment, the valve piston 144 is composed of a plastic material. The plastic may be, e.g., an acetal which includes compounds that are characterized by the grouping C(OR)2, such as Delrin®, a registered trademark owned by the E.I. du Pont de Nemours and Company. Such composition provides the valve piston 144 with a reduced frictional coefficient while still enabling a secure coupling with the main seal 142.

As further illustrated in FIG. 2, in an exemplary embodiment, an O-ring gasket 190 connects the top side 180, of the inner cap 150, with an inner wall 120 of the cap recessed area 119 of the aluminum cap 114. The O-ring gasket 190 provides a seal between the aluminum cap 114 and the inner cap 150. It is understood that the O-ring gasket 190 may enable various degrees of stretching and/or deflecting depending on the materials used to establish the O-ring gasket 190. This seal assists in directing the air flow provided into and out of the head valve assembly 140 via the inner cap inlet conduit 182 and the inner cap outlet conduit 184. In a preferred embodiment, the O-ring gasket 190 may nest in a groove established in the inner wall 120 of the aluminum cap 114. In an alternative embodiment, the O-ring gasket 190 may nest in a groove established in the top side 180 of the inner cap 150. It is further contemplated that the O-ring gasket 190 may be integrated with either the inner wall 120 of the aluminum cap 114 or the top side 180 of the inner cap 150.

Figure 4:
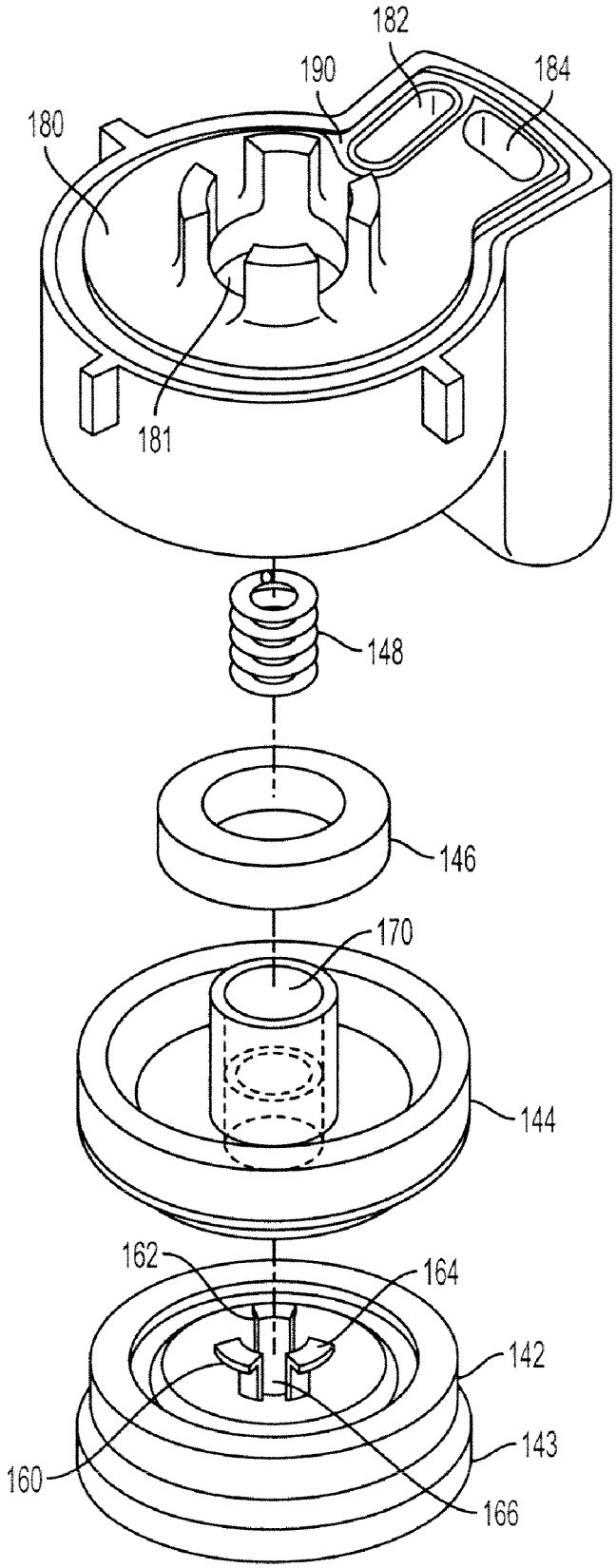
FIG. 4 is an illustration of the head valve assembly of FIG. 2, the inner cap having an inner diameter coupled with a main seal and valve piston.

As illustrated in FIG. 4, the inner cap 150 is further comprised of an inner cap exhaust conduit 184. The inner cap outlet conduit 184 directs the flow of exhausted air to the housing outlet port 123, established in the second end 109, of the housing 104, which is connected to the exhaust channel 128 within the handle 102. Thus, the exhausted air is removed from the head valve assembly 140 via the inner cap 150.

Figure 5:
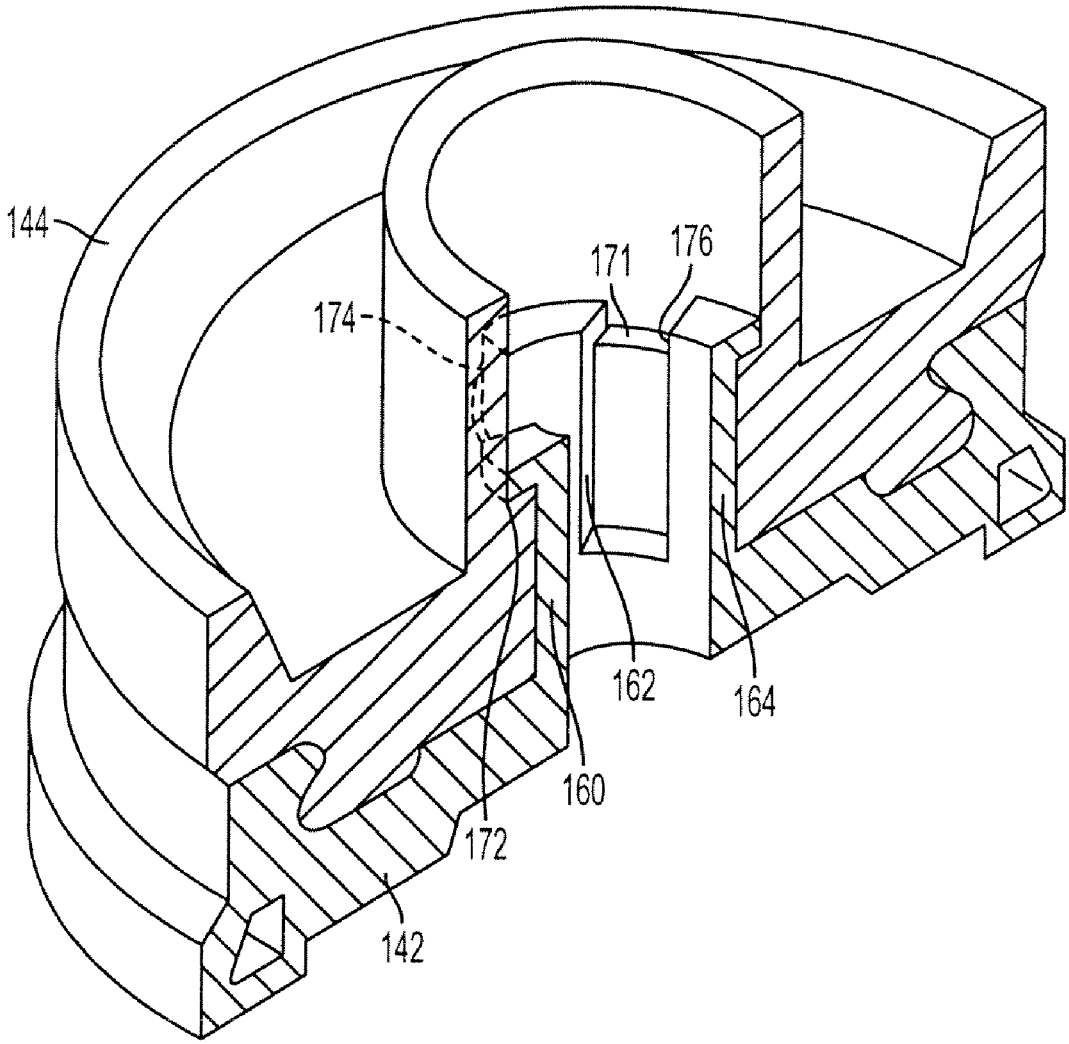
FIG. 5 is an illustration of the main seal connected with the valve piston of FIG. 2 through use of a snap lock mechanism.

It is contemplated that the coupling of the main seal 142 with the piston 134 may be accomplished in a variety of ways. For example, in an exemplary embodiment, the main seal 142 is coupled with the valve piston 144 via a snap lock mechanism. In an embodiment, as illustrated in FIGS. 4 and 5, the snap lock mechanism is enabled by a first leg 160, a second leg 162, and a third leg 164 which are connected to the main seal 142. In configuration, the legs 160 through 164 generally extend from the main seal 142 and include a tapered undercut on a flange included within each of the three legs. Further, on the end opposite the connection to the main seal 142, each leg terminates in a tab, which generally extends from the leg. The legs are formed about a piston projection receiving point 166. In the current embodiment, the piston projection receiving point 166 is an aperture, which extends through the main seal 142.

As illustrated in FIG. 5, in an exemplary embodiment, the legs 160 through 164 of the main seal 142 couple with a first leg receiver 172, a second leg receiver 174, and a third leg receiver 176, respectively. In the present embodiment, the leg receivers are disposed within a valve piston inner diameter of the valve piston 144. In a preferred embodiment, the three leg receivers are established by a ledge 171. In such embodiment, the ledge 171 includes three grooves for receiving the three legs of the main seal 142. In an alternative embodiment, the three leg receivers may be established as pockets disposed within the inner diameter of the valve piston 144. The three leg receivers 172 through 176 are configured with a matching profile to that of the three legs 160 through 164.

In operation, the three legs of the main seal 142 may be inserted within the three leg receivers of the valve piston 144. Upon being fully inserted, the tabs formed at the terminus of each leg may snap into place with respect to the leg receivers. The snapping into place may be accomplished in a variety of manners. In the present example, the material composition and configuration of the legs provide the force which snaps the tabs into place. The tabs assist in securing the position of the main seal 142 relative to the valve piston 144 by coupling the tabs against the valve piston 144. In alternative embodiments, the snap mechanism may be enabled as a spring loaded assembly and the like as contemplated by those of ordinary skill in the art. It is further contemplated that the main seal 142 and the valve piston 144 may be an integrated single unit.

In further embodiments, a secondary coupling of the valve piston 144 with the main seal 142 occurs via a tongue and groove assembly. The valve piston 144 includes a tongue member disposed about the circumference of a bottom edge of the valve piston 144. In a corresponding circumferential position on the main seal 142, a groove is established. Thus, when the main seal 142 is coupled with the valve piston 144, via insertion of the plurality of legs into the plurality of leg receivers, the tongue is inserted within the groove to provide secondary coupling support. It is contemplated that the secondary coupling characteristics may be provided through various alternative mechanisms. For example, the secondary coupling may be established by employing a friction lock mechanism, a compression lock mechanism, a latch mechanism, and the like, without departing from the scope and spirit of the present invention.

As illustrated in FIG. 6, in an exemplary embodiment, the piston projection receiving point 166 is configured to receive the piston projection 136. Therefore, as the configuration of the piston projection 136 is altered so to may the piston projection receiving point 166 and the three legs 160, 162, and 164 be altered to accommodate this change. The three legs 160 through 164, in a preferred embodiment, are enabled to trap and hold the piston projection 136 when extended through the piston projection receiving point 166.

Figure 8:
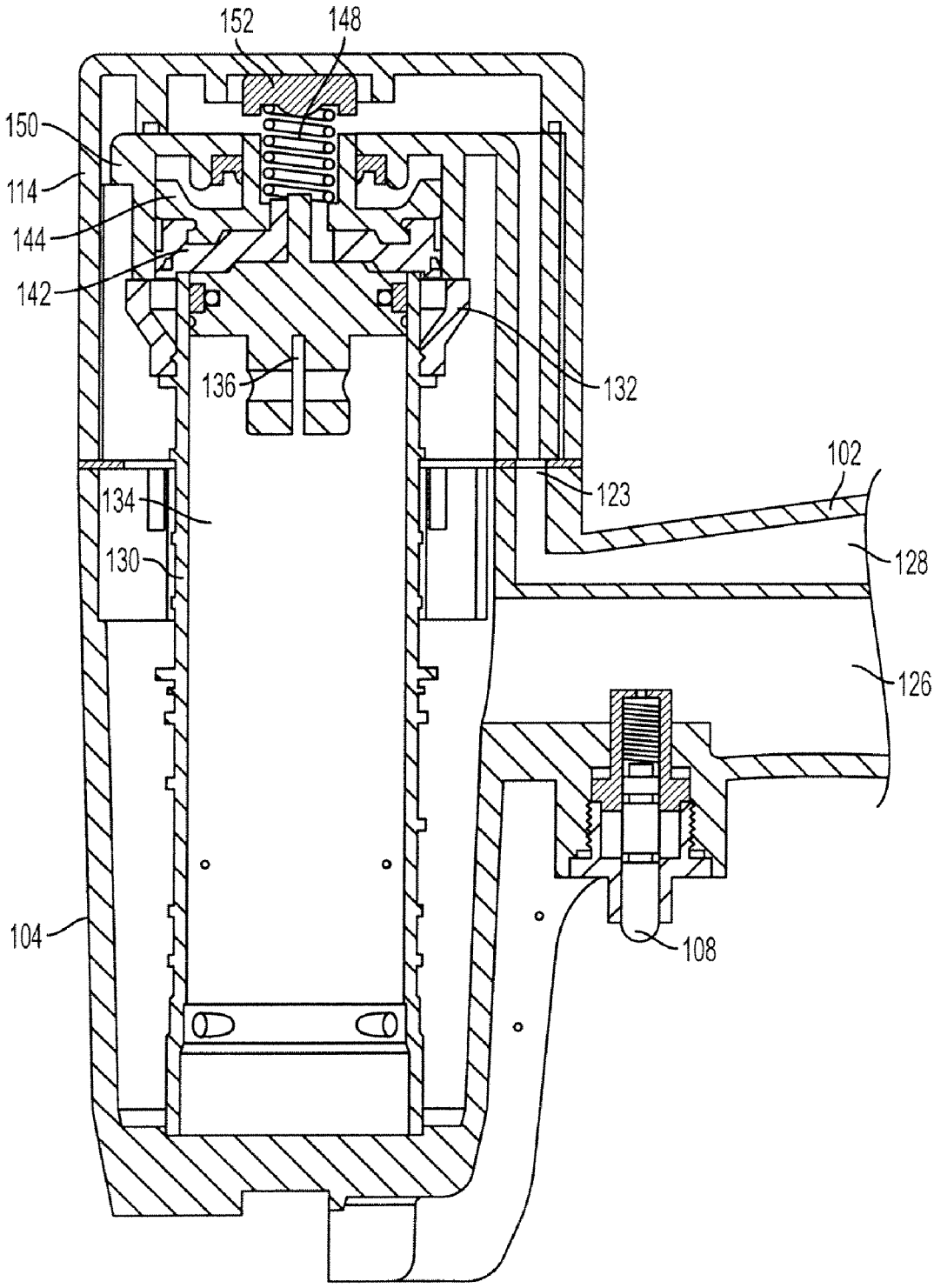
FIG. 8 is a cross-sectional view of the pneumatic fastener of FIG. 1 including the head valve assembly of FIG. 2 coupled with the piston assembly and the housing, the main seal and valve piston shown in a down position relative to the inner cap of the head valve assembly, in accordance with an exemplary embodiment of the present invention.
Figure 9:
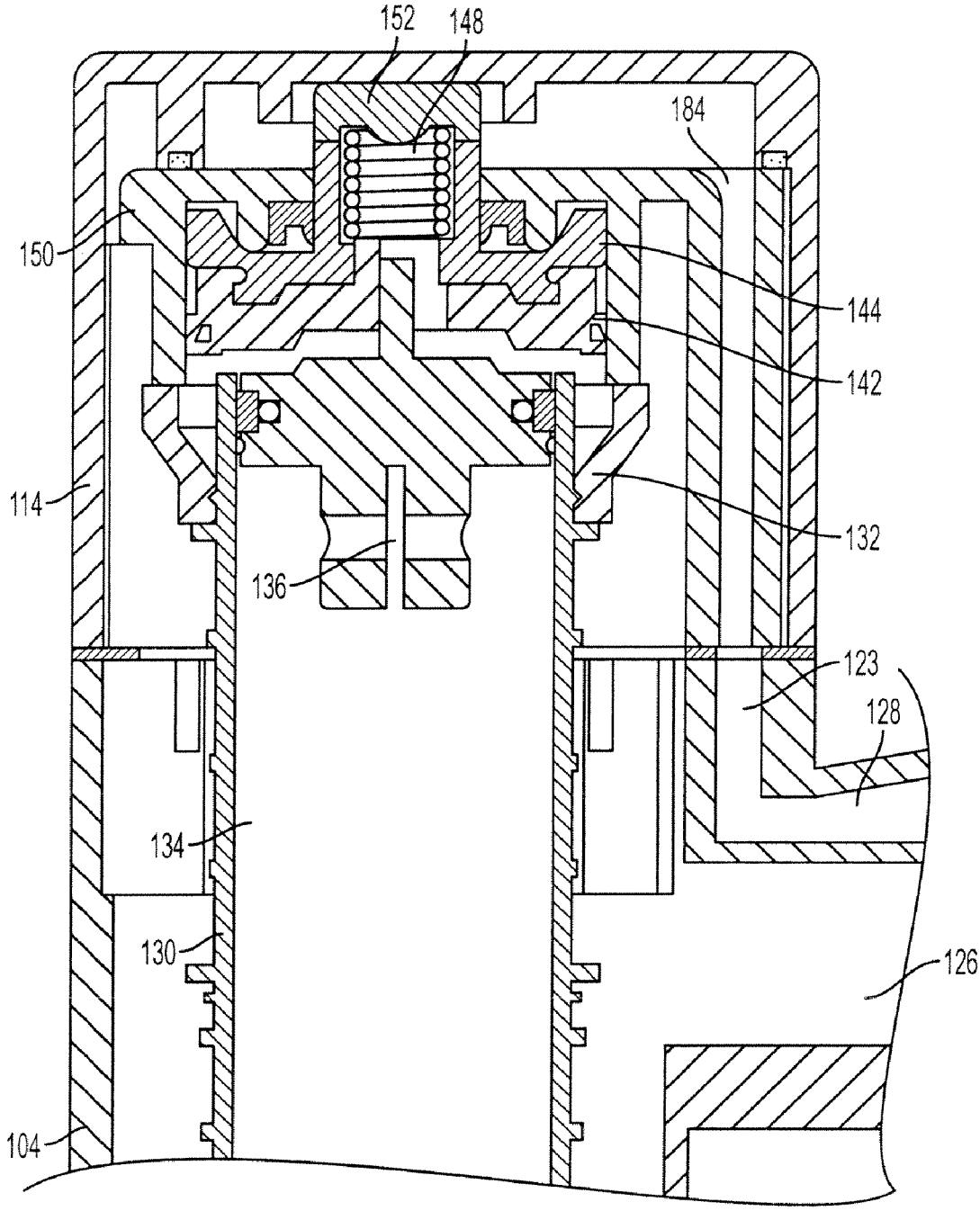
FIG. 9 is an expanded cross-sectional view of the pneumatic fastener of FIG. 1 wherein the main seal and valve piston of FIG. 2 are shown in an up position relative to the inner cap of the head valve assembly.

The securing of the piston projection 136 by the three legs may be accomplished using various mechanisms. In an embodiment, the three legs serve as a piston catch by providing a friction fit for engaging against the piston projection 136. Alternatively, the enabling of the piston catch may occur through the use of compression assemblies, ball joint assemblies, and the like. It is understood that the three legs trap and hold the piston projection 136 when the piston 134 is established in an "up" position (as illustrated in FIG. 9). It is further contemplated that the cylinder 130 may include a counter bore to further assist in maintaining the piston in the "up" position. The "up" position is the pre-fire position or the position the piston 134 returns to after the pneumatic fastener 100 has fired, using the compressed air to drive the piston 134 into a "down" position (as illustrated in FIG. 8). The "down" position provides the force for driving the driver blade through the nose casting, engaging with a nail located within the nose casting, and driving the nail into a surface against which the nose casting is set. The piston catch established by the present invention may provide increased efficiency by reducing any unwanted travel by the piston 134 towards the "down" position when the pneumatic fastener 100 is not being fired. For instance, when the pneumatic fastener 100 is set in a position to fire the user may tap the surface, inadvertently, being operated upon with the gun. This tap may result in the piston 134 traveling towards the "down" position. This travel may reduce the operational effectiveness of the pneumatic fastener 100 by limiting the range of travel of the piston 134 during firing of the gun 100, thereby, limiting the force provided by the piston 134 in driving the fastener, such as the nail, by the pneumatic fastener 100. This limited force may result in the fastener failing to reach the desired depth, such as by not recessing properly, which may have the effect of requiring additional time spent to accomplish a task. This may limit productivity and increase expenses associated with completing the task.

In an exemplary embodiment, as illustrated in FIGS. 8 and 9, a compression spring 148 is coupled against a bumper seal 152 on one end and the three legs 160, 162, and 164, snapped in position relative to the valve piston 144, on the opposite end. In the exemplary embodiment, the compression spring 148 extends through a spring receiving point 181 (as shown in FIG. 4) of the inner cap 150. In the current embodiment, as shown in FIG. 4, the spring receiving point 181 is an aperture through a top side 180 of the inner cap 150. The coupling against the three legs snapped into position relative to the valve piston 144 enables the compression spring 148 to "trap" the legs (as illustrated in FIG. 9), thereby, assisting in preventing the main seal 142 from being pulled away from the valve piston 144 by the piston 134 when fired.

The functionality of the compression spring 148 in combination with the snap fit of the main seal 142 with the valve piston 144 assists in enabling the main seal 142 to establish and maintain a seal between the supply pressure and the pressure behind the valve piston 144. In the current embodiment, the main seal 142 includes a main lip seal 143 to further assist in providing the above mentioned functionality. The main lip seal 143 further enables the main seal 142 to slidably couple with the inner diameter 151 of the inner cap 150. Thus, the main lip seal 143 enables the main seal 142 to travel within the inner cap 150 and maintain the seal between the supply pressure and the pressure behind the valve piston 144. It is understood, that the travel of the main seal 142 translates into a travel of the valve piston 144, within the inner cap 150, and the compression or extension of the compression spring 148. A secondary lip seal 146 is set upon the valve piston 144. The secondary lip seal 146 is set on the side opposite the coupling of the main seal 142 against the valve piston 144. The secondary lip seal 146 may assist in providing a seal between the valve piston 144 and the inner cap 150.

It is contemplated that the inner cap 150 may be composed of various materials. For example, the inner cap 150 may be composed of Delrin®, a registered trademark owned by the E.I. du Pont de Nemours and Company. Delrin® is an acetal which is a lubricious plastic providing a surface which may reduce the amount of turbulence/friction involved with the travel of the compressed air into or out of the head valve assembly 140 of the present invention. Further, the use of Delrin® for the valve piston 144, as stated previously, may reduce the amount of turbulence/friction encountered by the valve piston 144 during travel of the valve piston 144 within the inner diameter 151 of the inner cap 150. The materials used for the inner cap 150 may further comprise alternative plastics, Teflon® (a registered trademark of DuPont), silicone, and the like. While the present invention is enabled with the inner cap 150, which directs the air flow into and out of the head valve assembly 140 without requiring lubricants to be added, it is contemplated that various lubricants may be used in conjunction with the present invention. Lubricants, such as Teflon® based lubricants, silicone based lubricants, and aluminum disulfide based lubricants may be employed without departing from the scope and spirit of the present invention.

Figure 10:
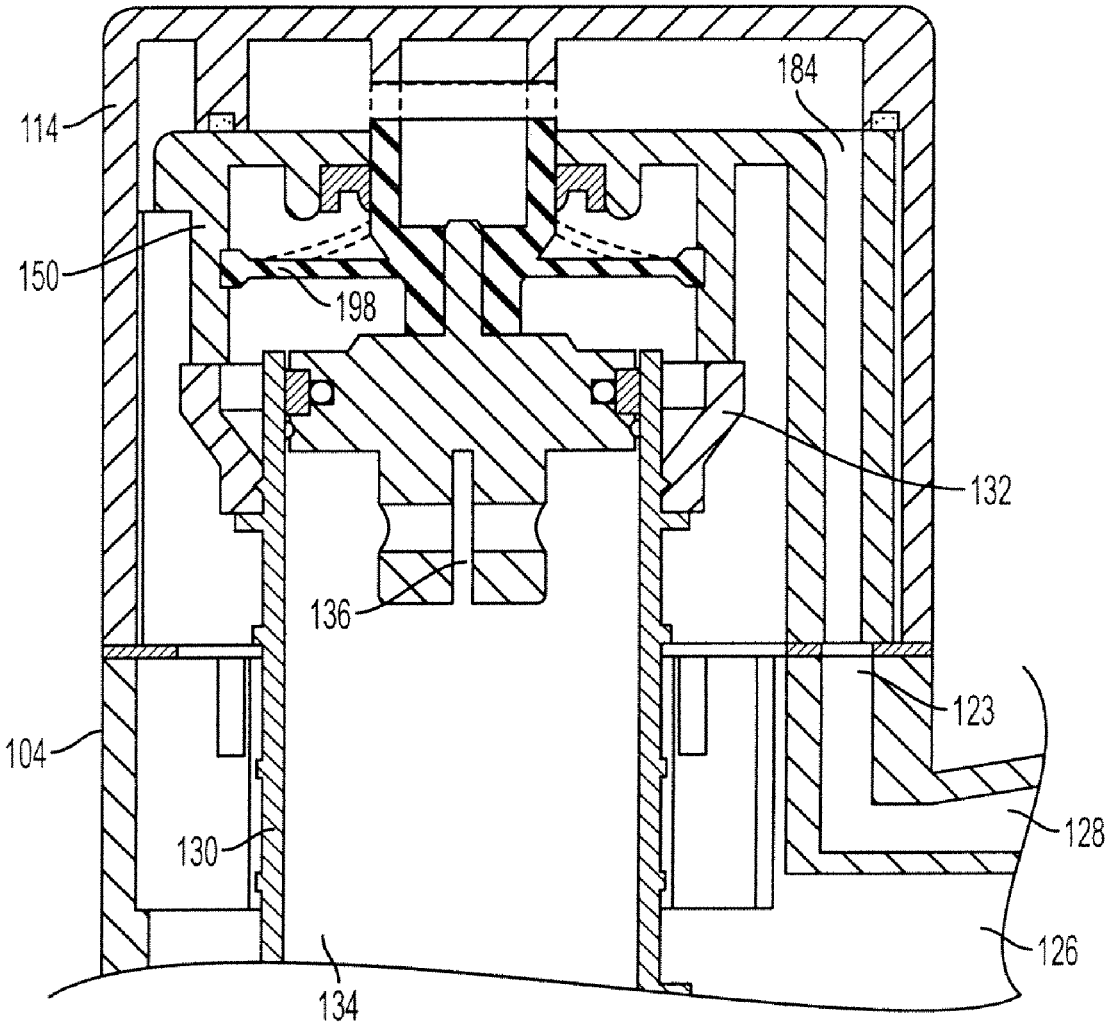
FIG. 10 illustrates the head valve assembly of FIG. 2 employing a diaphragm coupled with the inner diameter of the inner cap.

In an alternative embodiment, the main seal 142 and valve piston 144 may be replaced by a diaphragm 198, as illustrated in FIG. 10. The diaphragm 198 provides the functionality of the main seal 142 coupled with the inner diameter 151 of the inner cap 150, of the head valve assembly 140. The diaphragm may also couple with the cylinder 130, at least partially surrounding the cylinder 134. The diaphragm may be composed of various materials, which provide various degrees of stretching and/or deflecting of the diaphragm. This stretching and/or deflecting may translate into movement by the diaphragm 198 within the inner diameter 151. As previously stated, this may further translate into the extension and/or compression of the compression spring 148. It is still further contemplated that the use of the diaphragm 198 may eliminate the need for the compression spring 148. It is understood that the configuration of the diaphragm 198 may be altered to accommodate the needs of the manufacturer, consumer, or those of ordinary skill in the relevant art. It is further contemplated that the diaphragm 198 may be employed in conjunction with the main seal 142 and the valve piston 144. The diaphragm 198 may couple with the main seal 142 and any stretching/deflecting of the diaphragm 198 within the inner diameter 151 of the inner cap 150 may translate into movement of the main seal 142 and valve piston 144 within the inner diameter 151.

During use, compressed air travels through the inner cap 150 and into the head valve assembly 140 via an inner cap inlet conduit 182. The inner cap inlet conduit 182 establishes an air flow pattern through the inner cap 150 from the inlet channel 126 of the handle 102. The housing inlet port 121, established on the second end 109 of the housing 104, enables the compressed air being provided through the inlet channel 126, to flow into the inner cap inlet conduit 182. The compressed air supplied through the inner cap inlet conduit 182 enables the head valve assembly 140 to operate the pneumatic fastener 100, i.e., the firing of the piston 134 to drive the fastener into a surface or work piece.

Referring to FIGS. 16-18B, another embodiment of a pneumatic fastener 1600 includes a handle 1602, a housing 1604, and a trigger assembly 1608 that are analogous to the handle 102, housing 104, and trigger assembly 108 of the pneumatic fastener 100. In particular, the handle 1602 includes an inlet (supply) port 1621 and inlet channel 1626 and an outlet (exhaust) port 1623 and outlet channel 1628 defined therein. Inside the housing 1604 is an engine analogous to the engine of the pneumatic fastener 100, including a cylinder 1630, a basket 1632, a piston 1634, and a valve piston 1644, analogous to the cylinder 130, basket 132, piston 134, and valve piston 144 in the pneumatic fastener 100. The basket 1632 seats on top of the cylinder 1630 to form a seal between the top of the cylinder 1630 and the valve piston 1644. Housing 1604 also includes a bulkhead 1692 that surrounds the cylinder 1630 and divides the chamber region surrounding the periphery of the cylinder into a storage chamber 1694 that stores air to drive the piston and a return chamber 1696 that receives exhaust air from the cylinder. Coupled to housing 1604 is an outer cap 1620. Outer cap 1620 is sealed to housing 1604 by a seal 1690 disposed between outer cap 1620 and housing 1604. In an alternative embodiment, the seal may be disposed in a groove in the outer cap and/or the housing. At least partially disposed within the outer cap 1620 and disposed between the outer cap 1620 and the valve piston 1644 is an inner cap 1650.

Figure 19:
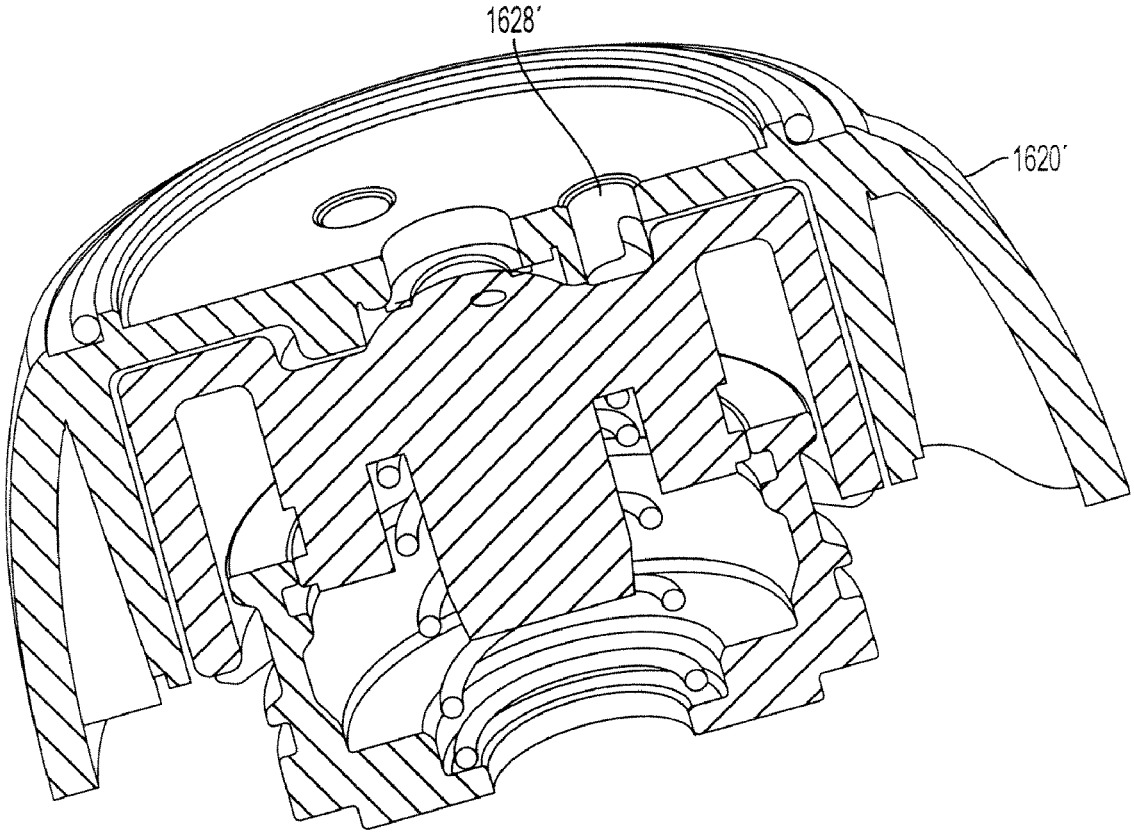
FIG. 19 is a cross-sectional view of an alternative embodiment of the end cap and inner cap of the pneumatic fastener shown in FIGS. 16-18B.

Pneumatic fastener 1600 differs from pneumatic fastener 100 in the configuration of outer cap 1620 and inner cap 1650. Outer cap 1620 defines therein an inner passageway 1612 in communication with inlet channel 1626 to deliver compressed air to the valve piston 1644, and an exhaust passageway 1614 in communication with outlet channel 1628 to deliver exhaust gas from the cylinder 1630 to the exhaust outlet channel 1628. In an alternative embodiment, as shown in FIG. 19, the outer cap 1620' has an exhaust passageway 1628' that passes the exhaust air to atmosphere without the exhaust air traveling through the handle of the tool. Inner cap 1650 is disposed between outer cap 1620 and valve piston 1644. Inner cap 1650 includes a central aperture 1652 that receives a projection 1646 of valve piston 1644, a spring (not shown), and a bumper 1648 to seat the valve piston 1644 in the inner cap 1650. Inner cap 1650 also has a generally cylindrical sidewall 1654 that defines a plurality of slot-shaped apertures 1656 therethrough. Apertures 1656 are in communication with a space between inner cap 1650 and outer cap 1620 and with a space between inner cap 1650 and the top of valve piston 1644. The space between the inner cap 1650 and the outer cap 1620 is in communication with the trigger valve 1660 via a passageway (not shown).

In use, when the tool is attached to a source of compressed air, the air travels through inlet passageway 1626, through trigger valve 1660, enters the space between outer cap 1620 and inner cap 1650, and is delivered to the space above the valve piston 1644 via slot-shaped apertures 1656 to push the valve piston 1644 downward against the cylinder. At the same time, compressed air fills the storage chamber 1694 about the outside of the cylinder. When the user pulls the trigger 1608, the trigger valve 1660 is opened to the atmosphere. The air above the valve piston 1644 exits the tool by passing through apertures 1656 in the inner cap 1650 and through the trigger valve 1660. This causes the valve piston 1644 to move upward away from the top of the cylinder, allowing the air in the storage chamber 1694 to enter the cylinder and drive the piston 1634 downward to drive a fastener. After driving the fastener, when the user releases the trigger, the valve piston 1644 is repositioned downward against the cylinder. At this point, the compressed air inside the cylinder exits the tool by passing through a central opening in the valve piston 1644 and through the central opening 1652 in the inner cap, and then through exhaust passage 1628. The valve piston 1644 is then repositioned downward against the cylinder for another tool actuation.

Inner cap 1650 may be composed of a material that reduces the amount of turbulence and/or friction involved with the travel of air into or out of the inner cap 1650 and/or reduces the amount of friction between the inner cap 1650 and the valve piston 1644. In addition, the inner cap 1650 and the valve piston 1644 may be composed of the same or similar materials, for example, so that they undergo thermal expansion and contraction at the same or similar rates, which reduces part wear, the need for lubrication, and part failure. For example, the inner cap 1650 and/or the valve piston 1644 may be composed of a lubricious plastic such as Delrin®, Teflon®, or silicone. While the inner cap 1650 and valve piston are configured to be operated without added lubricants, it is contemplated that various lubricants may be used, e.g., Teflon® based lubricants, silicone based lubricants, and aluminum disulfide based lubricants.

Referring to FIGS. 11-13C, a pneumatic fastener 1100 including a dual actuation mode assembly 1102 is discussed. Those of skill in the art will appreciate that while a pneumatic fastener is discussed, the principles of the present invention may equally apply to devices utilizing a combustion event or a detonation event to secure a fastener such as a nail, a staple, or the like. The dual actuation mode assembly 1102 permits user selection of the type of actuation the fastener device is to operate (e.g. in a contact fire mode or sequential actuation mode). In contact actuation mode, a user pulls (and holds) the trigger 1104 and subsequently the contact safety assembly 1 106 is depressed or pushed inwardly toward a driver housing 1108 thereby activating a pneumatic valve 1109 for releasing compressed air to drive a piston and driver into contact with a nail or fastener disposed in the driver's path of travel. Subsequent fastening events, in contact actuation mode, may be initiated by movement of the contact safety towards the driver housing such as when the pneumatic fastener 1100 has been repositioned and pressed against a workpiece. In sequential fire mode, the contact safety assembly is depressed toward the driver housing and subsequently the trigger is pulled to initiate a fastening event (the driving of a nail, staple or the like).

Figure 11:
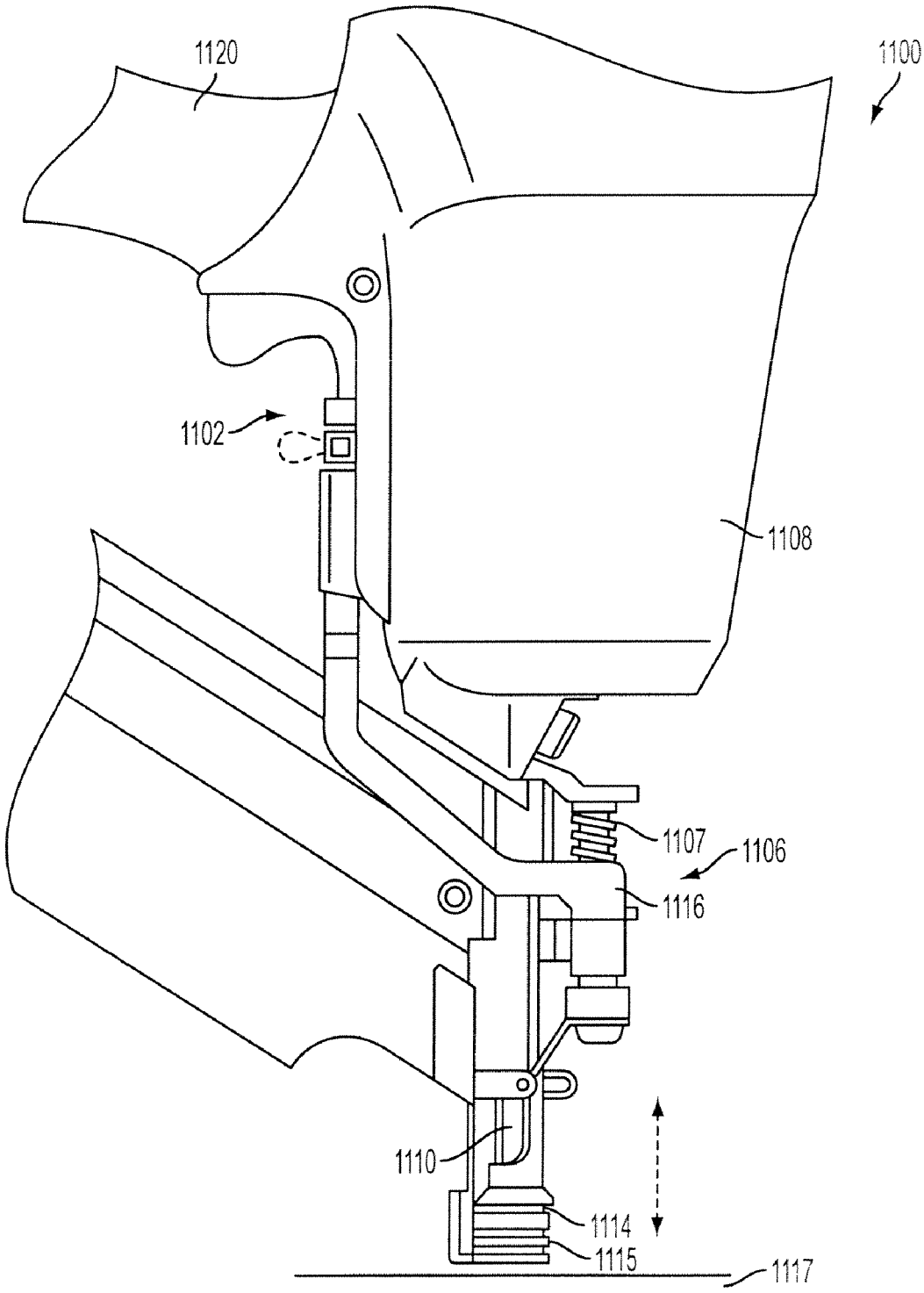
FIG. 11 is a partial side view illustration of a dual actuation mode assembly for use with a pneumatic fastener.
Figure 12:
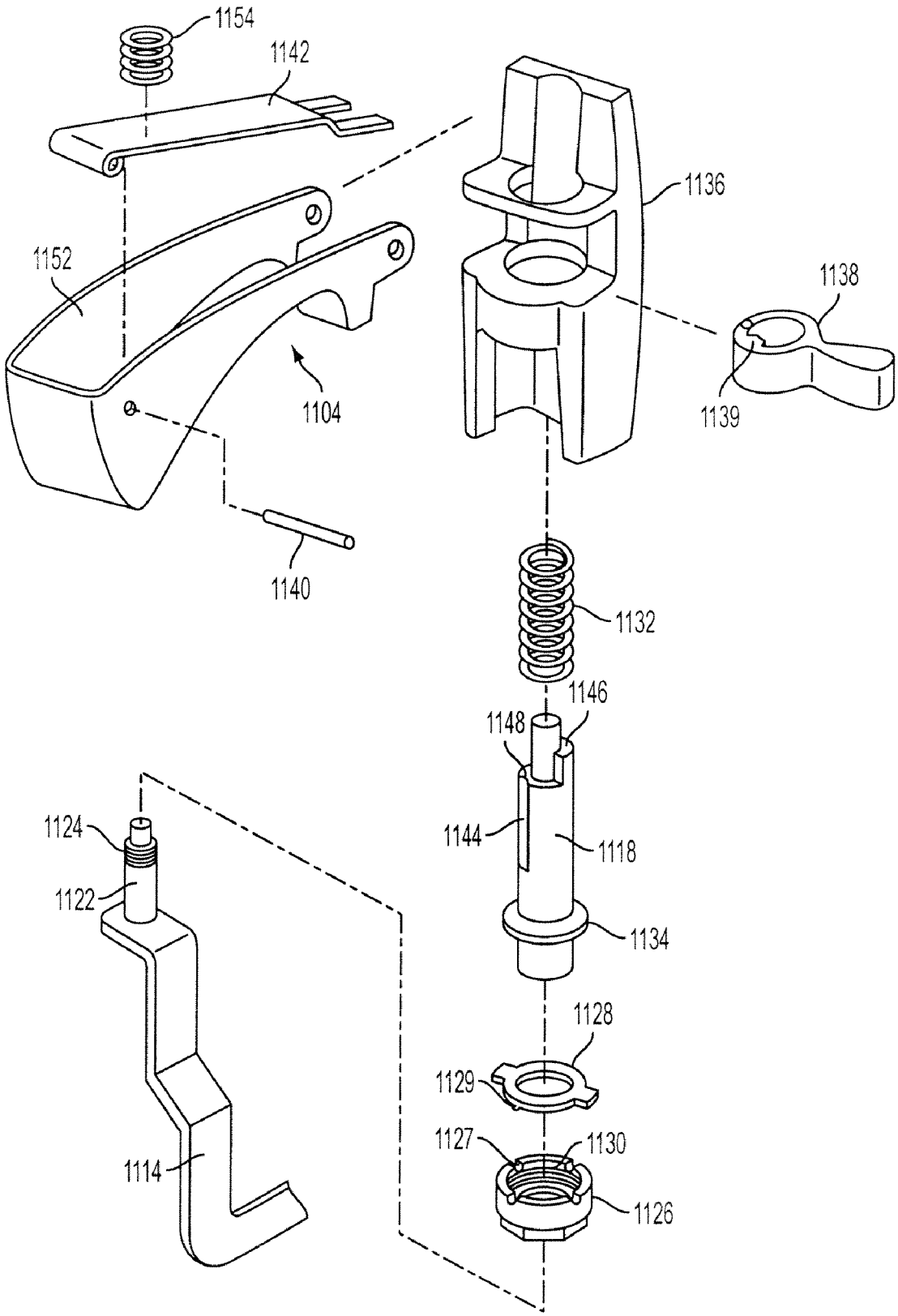
FIG. 12 is an exploded view of the contact safety of the dual actuation mode assembly illustrated in FIG. 11.

With particular reference to FIGS. 11 and 12, the pneumatic fastener 1100 includes the driver housing 1108 for housing a reciprocating piston including a driver blade attached thereto for driving a fastener disposed within the path of travel of the driver blade. A contact safety assembly 1106 is adjustably mounted to the driver housing 108 in order to permit the contact safety assembly to slide towards and away from to the driver housing/the nose 1110 of the driver housing. In various embodiments, the nose may be formed as a separate structure or may be integrally formed with the main portion of the driver housing 1108. Preferably, the contact safety assembly 1106 is biased, such as by a main spring or the like, into a remote position or away from the nose 1110 of the driver housing. Biasing the contact safety assembly away from the main portion of the fastener permits the contact safety system to function as a lock-out mechanism so that the pneumatic fastener cannot actuate. Additionally, as described above, the contact safety assembly 1106 may be utilized to initiate a fastening event (in contact mode).

The contact safety assembly 1106 includes a contact pad 1114 or foot for contacting with a workpiece. Additionally, a no-mar tip may be releasably connected to the contact pad for preventing marring of the workpiece, if the contact pad is formed of metal or includes a serrated edge for engaging a workpiece (such as in a framing nailer). For example, the contact pad 1114 may be shaped so as to translate or slide along the nose 1110 of the driver housing 1108. In the present embodiment, the contact pad 1114 is generally shaped as a hollow cylindrical structure for sliding along the generally cylindrical nose. An intermediate linkage 1116 is coupled to the contact pad 1114 to generally position a cylindrical rod 118 along the driver housing 1108. For example, the movement of the intermediate linkage may permit the cylindrical rod 1118 to be variously positioned with respect to the driver housing 1108 and thus, a trigger assembly which is 1104 pivotally mounted to the driver housing 1108 and/or a handle 1120 fixedly secured to the driver housing 1108. In the current embodiment, the intermediate linkage 1116 is secured via a fastener to the contact pad 1114. In further embodiments, the contact pad and linkage may be unitary. In the present example, the intermediate linkage is constructed in a general L-shape to position the rod 1118 adjacent the trigger (i.e., towards the handle 1120). Additionally, the intermediate linkage may be constructed so as to generally conform to the driver housing, to avoid other pneumatic fastener components, i.e., avoid fastener magazine components, for aesthetic purposes or the like. Moreover, in the present instance, the intermediate linkage 1116 includes a pivot pin 1122 coupled to an end of the linkage 1116. The pivot pin 1122 may be secured via a fastener, a friction fit or unitarily formed with the intermediate linkage. In the present embodiment, the pivot pin 1122 is received in an aperture defined in a tab which extends generally perpendicular to a leg of the generally L-shaped linkage. A portion of the pivot pin 1122 may be received in a corresponding cylindrical recess formed in the rod 1118 for at least partially supporting/pivotally connecting the rod 1118 to the intermediate linkage via the pivot pin 1122.

Figure 13A:
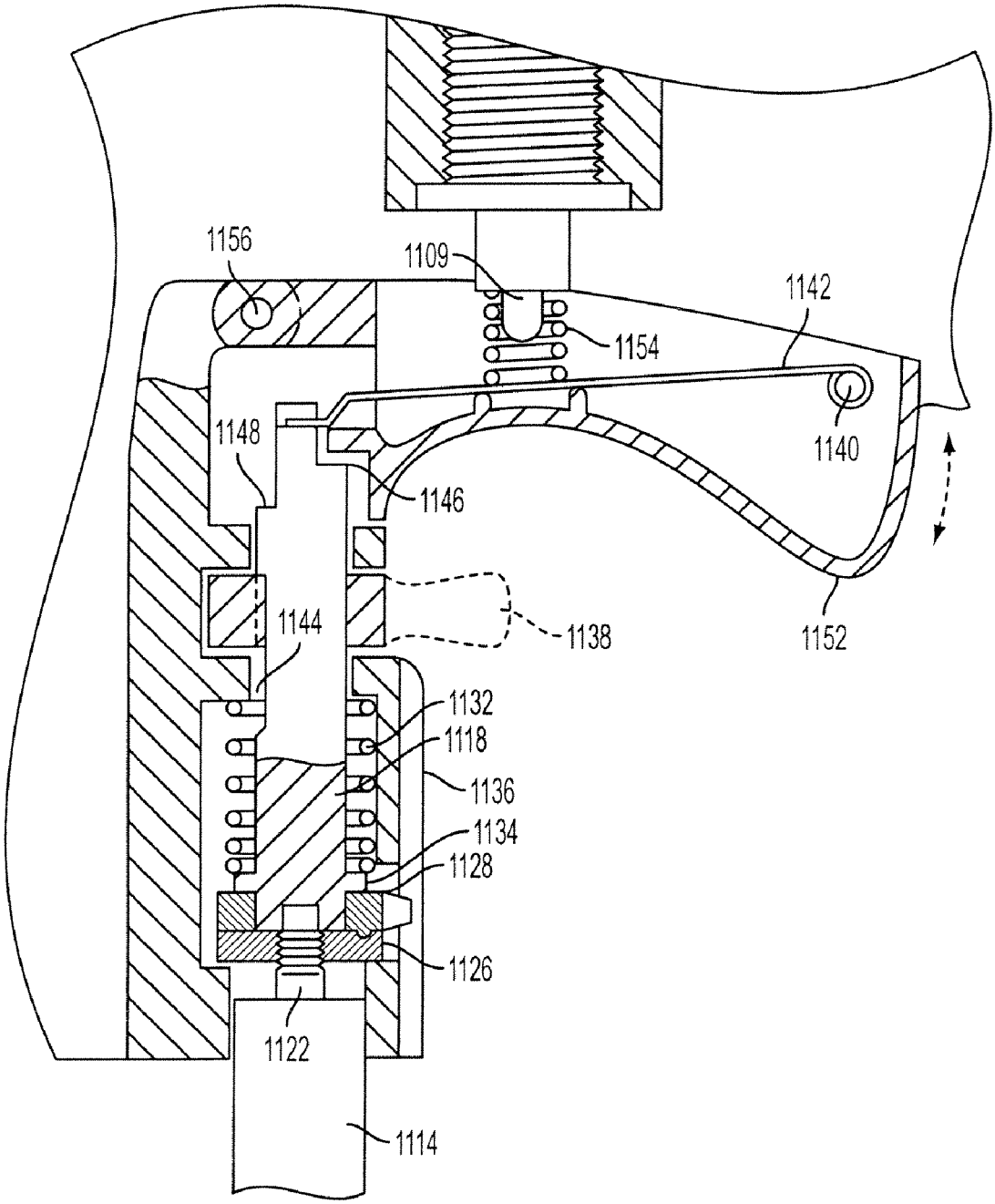
FIG. 13A is a cut-away side view of a dual actuation mode assembly of FIG. 11.

Referring to FIGS. 12 and 13A, in an additional aspect of the present invention, the contact safety assembly 1106 includes an optional depth of drive or recess adjustment capability. A depth adjustment system permits a user to select to what extent the fastener is to be driven into the workpiece via selecting the extent to which the contact safety extends towards/away from the driver housing. Those of skill in the art will appreciate that a variety of factors will influence the depth to which a fastener will be driven. For example, a user may wish to leave the head of a nail above the surface of the workpiece (i.e. leave the nail proud) or may select to recess the nail head into the workpiece such that putty or filler may be filled into the recess thereby covering over the nail head (e.g., when building cabinetry or the like). In the present instance, the pivot pin 1122 includes a threaded portion 1124 or section for threading with a thumb wheel 1126. A thumb wheel 1126 includes a corresponding aperture having a threaded portion 1130 such that the thumb wheel 1126 may travel along the threaded length of the pivot pin 1122. The thumb wheel thereby may extend the overall length of the contact safety assembly and thus, vary the depth to which a fastener may be driven through interaction with the pneumatic valve 1109 for controlling the flow of compressed air into the driver cylinder.

In the foregoing example, the thumb wheel 1126 may frictionally interconnect with a washer 1128, disposed between the thumb wheel 1126 and a lip/flange 1134 included on the rod, via a series of rib/grooves, detents and protrusions or the like. It is to be appreciated that the rod 1118 is permitted to freely pivot (e.g., not in threaded engagement) about the pivot pin 1122. For example, the rod 1118 and thus, the washer 1128 may be biased such as via a spring 1132 towards or into engagement with the thumb wheel 1126. Preferably, the washer 1128 may be geometrically shaped or include protrusions such that the washer 1128 does not rotate with the thumb wheel 1126, e.g., remains in a fixed orientation with respect to the driver housing and/or a secondary housing or contact safety housing 1136 coupled to the driver housing for at least partially encompassing at least a portion of the contact safety assembly. The series of protrusions/detents may act to retain the thumb wheel 1126 in a desired position along the pivot pin 1122. Those of skill in the art will appreciate that the depth adjustment mechanism may be formed with a threaded projection in threaded connection with an end of a rod so as to effectively extend/retract the overall length of the rod. In the previous example, the projection is received in a recess formed in an intermediate linkage such as a tab included on an end of the linkage. For example, a rod may include a threaded portion along which a thumb wheel is in threaded engagement while the terminal portion of the rod is inserted in an aperture in an intermediate linkage.

In further embodiments, a depth of drive mechanism may be disposed between the contact pad 1114 and an intermediate linkage 1116. Additionally, if a depth of drive or recess adjustment is not desired, the rod 1118 may extend into a recess or aperture included in a tab extending from an end of an intermediate linkage. In still further embodiments, a partially threaded pivot pin may be threaded into an aperture in the intermediate linkage and function as a pivot pin for the rod 1118. Alternatively, a rod may include an extension which may be received in an aperture in the intermediate linkage for achieving substantially the same functionality.

Figure 13B:
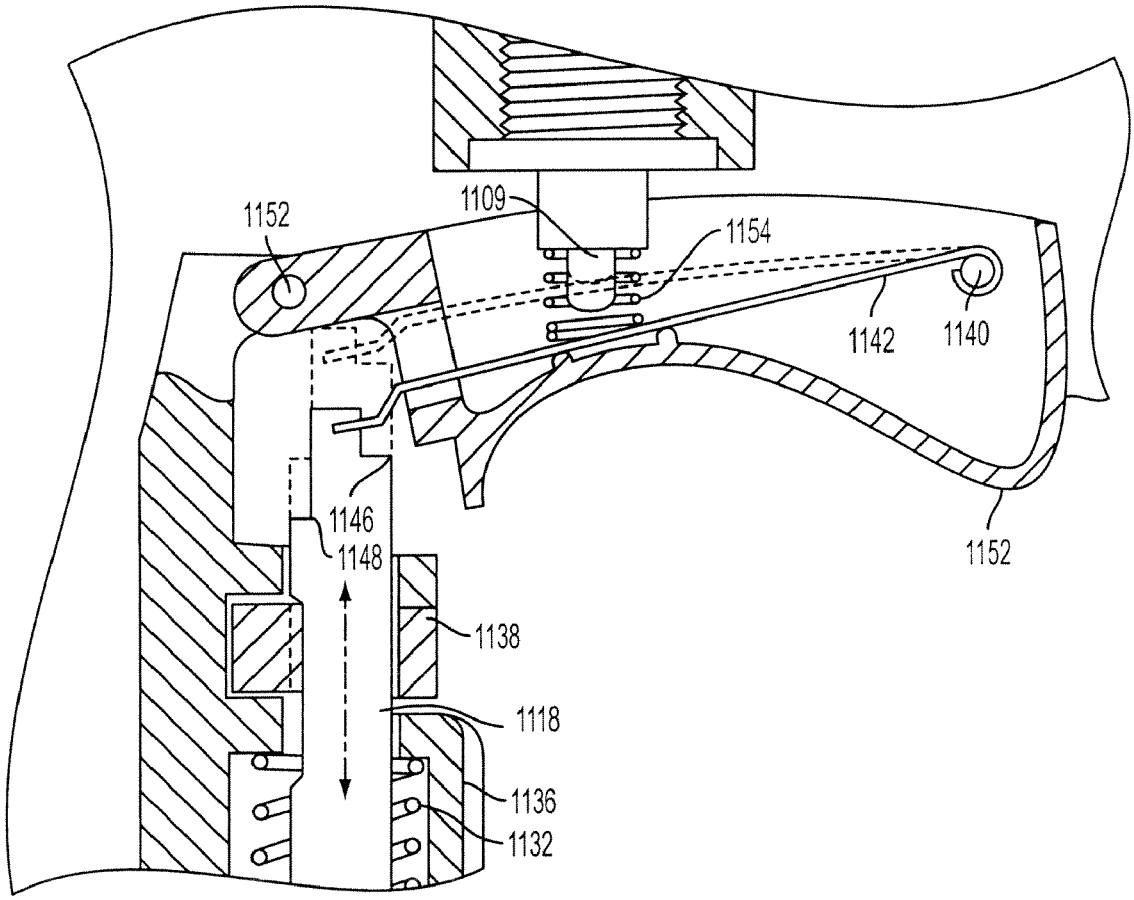
FIG. 13B is a cut-away side view of the dual actuation mode assembly of FIG. 11 illustrating a rotating rod in contact actuation mode.
Figure 13C:
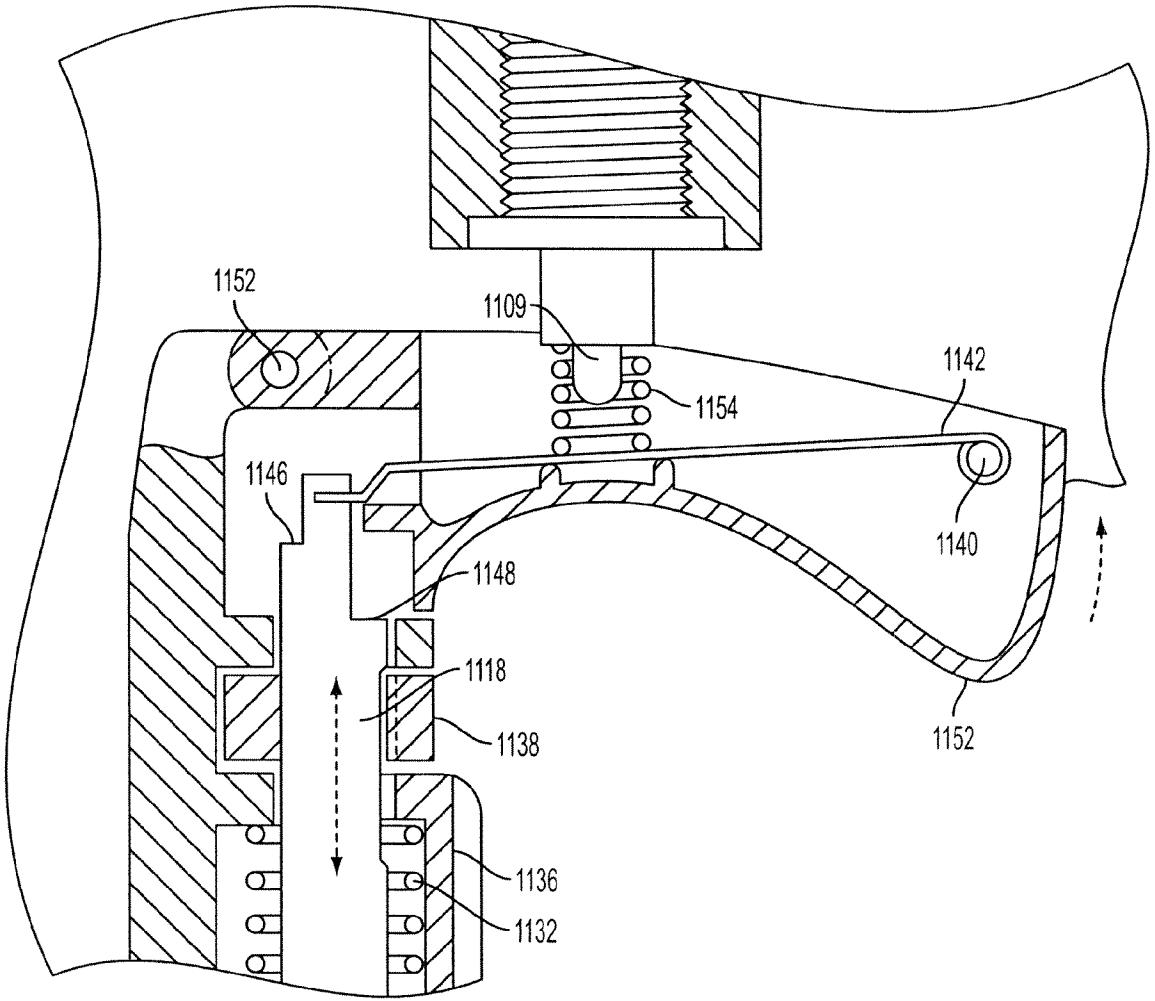
FIG. 13C is a cut-away side view of the dual actuation mode assembly of FIG. 11 illustrating a rotating rod in sequential actuation mode.

With particular reference to FIGS. 12 and 13A-C, the rod 1118 includes a first shoulder 1146 and a second shoulder 1148. The first and the second shoulders are formed at offset distances along the length of the rod 1118 such that the orientation of a trigger 1152 and thus, a trigger lever 1142 pivotally coupled via a trigger lever pivot pin 1140 to the trigger may be varied. For example, the orientation/lateral position of the trigger lever 1142 permits selecting contact actuation mode (as illustrated in FIG. 13B) when the first shoulder 1146 is orientated or rotated towards the trigger 1152. While sequential actuation (as observed in FIG. 13C) 1148 is achieved when a second shoulder which is further from the terminal end of the rod 1118 than the first shoulder 1146 is orientated or rotated towards the trigger 1152. The particular actuation mode selected (i.e., contact actuation or sequential actuation) is determined by the change in orientation/lateral position of the trigger 1152/trigger lever 1142 as the trigger assembly 1104 pivots about a trigger pivot pin 1156 and the selected shoulder contacts the trigger 1152. For example, as the trigger 1152 pivots about the trigger pivot pin 1156 and contacts with the select shoulder, included on the rod, such that the shoulder acts as a stop against which the trigger 1152 is positioned. Those of skill in the art will appreciate that the interface of the rod/trigger is off-centered from the trigger pivot pin 1156 thereby varying the point (along the trigger lever 1142) at which the valve 1109 will contact the trigger lever 1142 due to the relative orientation/position of the trigger lever 1142. In further embodiments, the trigger lever 1142/trigger 1152 is biased away from the pneumatic valve 1109 by a spring 1154 or the like such that a user is required to overcome the biasing force to activate the valve 1109. In the present embodiment, a central cylindrical projection extends beyond the first and the second shoulders 1146 and 1148, respectively. In this instance, the trigger lever and trigger, such as the lipped portion of the trigger for engaging a shoulder, may include a curved recess to permit passage of the projection. The trigger lever 1142 may be configured to engage with the rod 1118 so as to prevent a repeated fastening event when sequential actuation or firing mode is selected. In further instances, the first and the second shoulders may be formed by milling flattened portions into a rod. Preferably, the shoulders are arranged at 180° (one hundred eighty degrees) from each other to permit sufficient engagement of the trigger and the selected shoulder.

With continued reference to FIGS. 11-13 C, orientation of the rod 1118 may be achieved by rotating the rod 1118 such that a selected shoulder (the first shoulder 1146 or the second shoulder 1148) is aligned with a lip included on the trigger 1152. A toggle lever or switch 1138 is coupled to the rod 1118. In the present embodiment, the toggle switch 1138 is positioned below the trigger 1152 (with respect to the handle 1120) in order to permit a user to rotate the rod 1118 and thus, vary the pneumatic fastener's actuation mode by utilizing his/her forefinger and thumb. This positioning is additionally advantageous as a user may efficiently select between actuation modes without the complexity previously experienced. In the foregoing manner, a user may select between actuation modes more frequently thereby increasing efficiency over systems which require complex, time consuming manipulation. Preferably, the toggle switch defines an aperture through which the rod 1118 passes. In the present embodiment, a protrusion 1139 is formed by the toggle switch for extending into a keyway or channel extending longitudinally along at least a portion of the rod. In further embodiments, a setscrew may be utilized to accomplish this function. Those of skill in the art will appreciate a variety of mechanical interconnect systems may be implemented to achieve this function. For example, a portion of the rod may have a hexagonal cross section while a toggle switch includes a hexagonal aperture, a portion of the rod may be milled off or have a flattened portion or the like. Inclusion of a keyway or the like structure permits the toggle switch to remain in a fixed position (held in place via the contact safety housing 1136) with respect to the contact safety housing 1136/the driver housing 1108 while the rod is permitted to variously position along the driver housing. Those of skill in the art will appreciate that the toggle may be fixedly secured to the rod as well so that the toggle switch travels with the rod 1118 as the contact safety assembly 1106 is manipulated generally along the driver housing.

In further examples, the toggle switch 1138 may include a detent for engaging with the contact safety cover in order to frictionally secure the toggle switch in a desired orientation (i.e. contact actuation or sequential fire). Moreover, the toggle switch may include a cam shaped outer surface for frictionally engaging the contact safety housing to retain the toggle in a desired orientation. For example, a detent and/or cam surface may be included to secure the toggle switch in sequential fire mode. Those of skill in the art will appreciate that the lever portion of the toggle may act as an indicator or indicia of the selected actuation mode to permit ready recognition. Additional symbols or markings may be included on the driver housing, the contact safety housing or provided as an adhered label to one of the housing to alert the user as to the mode selected. Preferably, the toggle switch is orientated at 90° (ninety degrees) or perpendicular to a main axis of the trigger so that the selected contact mode is readily observed. For example, the toggle lever may be orientated approximately 180° (one hundred eighty degrees) when disposed in contact actuation mode than when disposed in sequential actuation mode.

Figure 14:
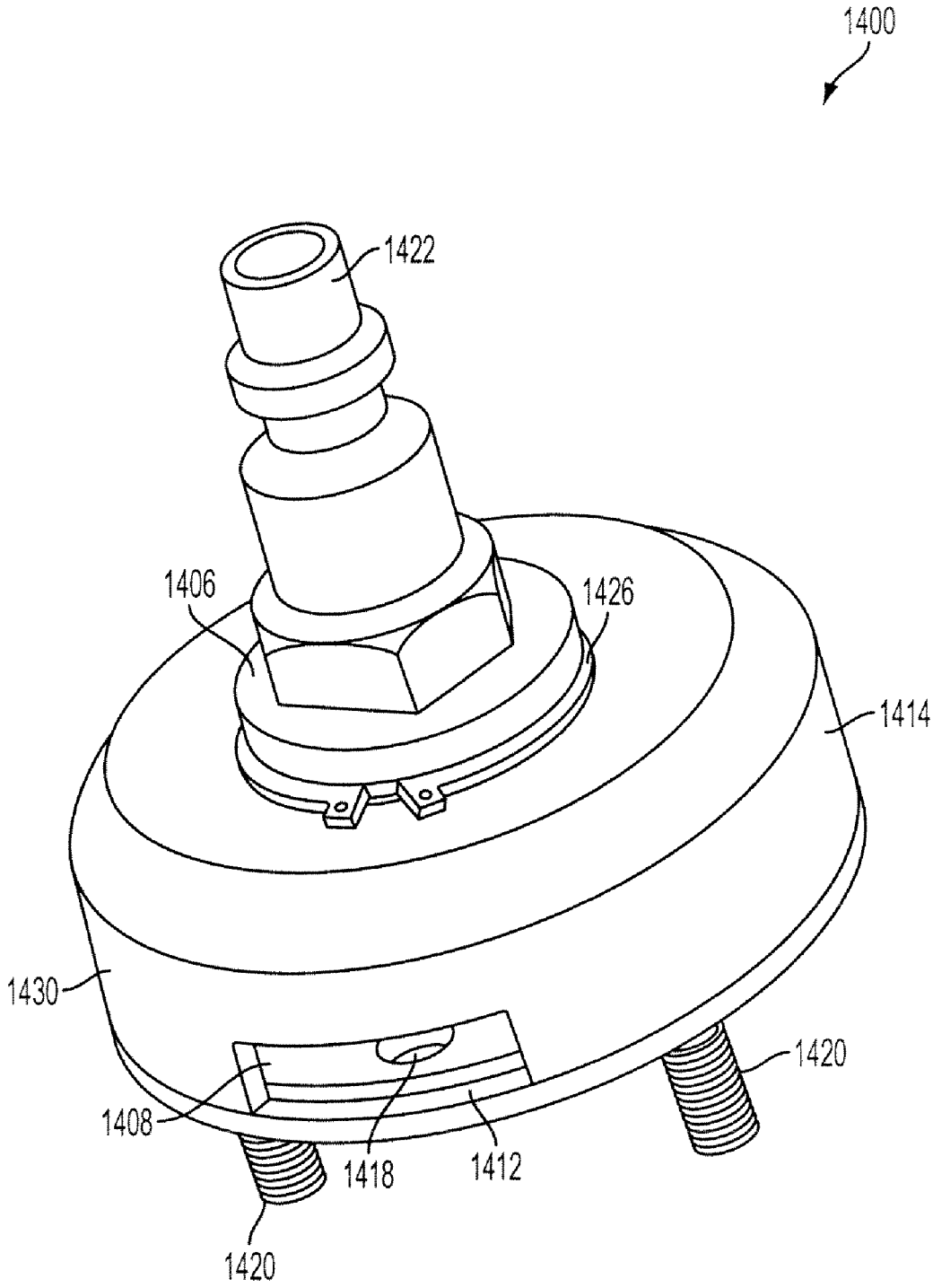
FIG. 14 is an illustration of an adjustable handle exhaust assembly for use with a pneumatic fastener.
Figure 15:
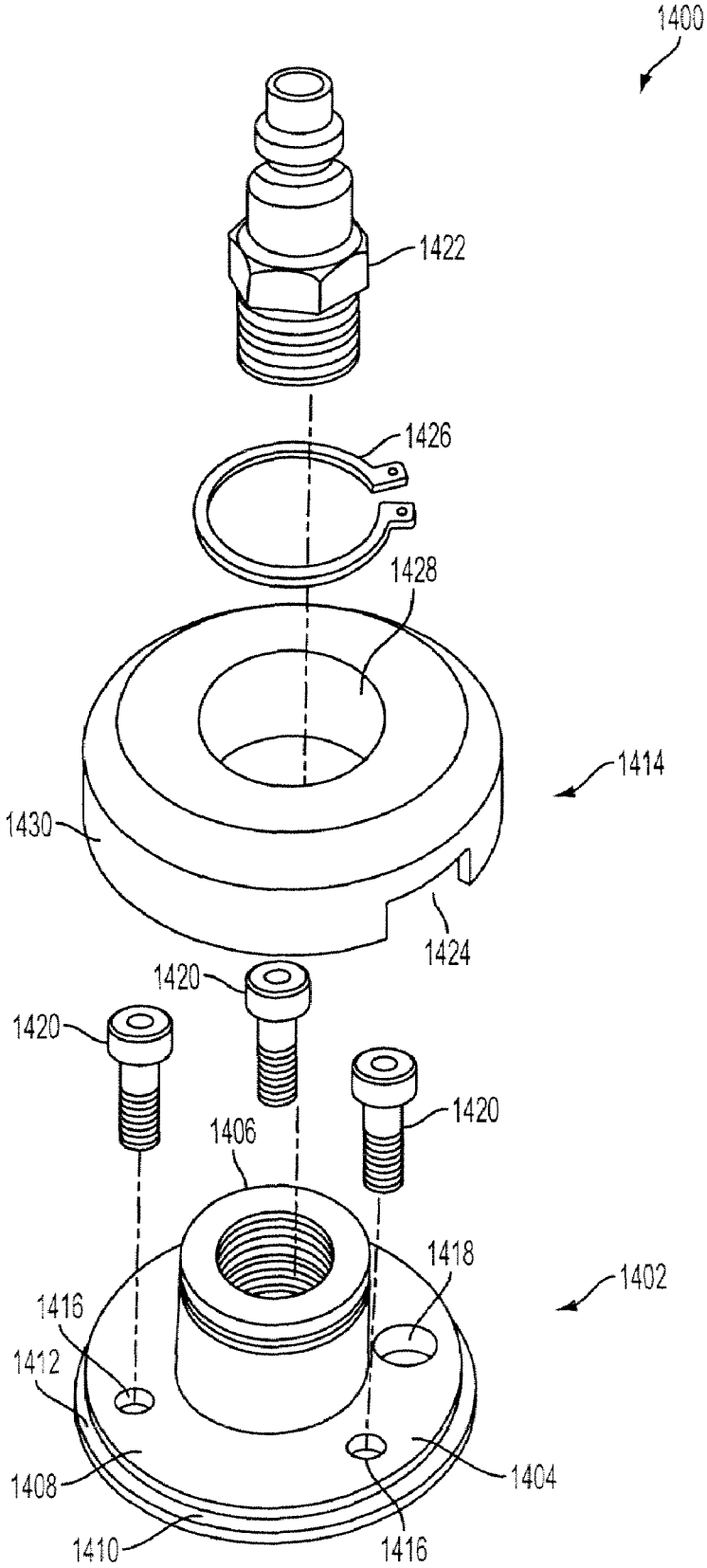
FIG. 15 is an exploded view of the adjustable handle exhaust assembly of FIG. 14.
Figure 16:
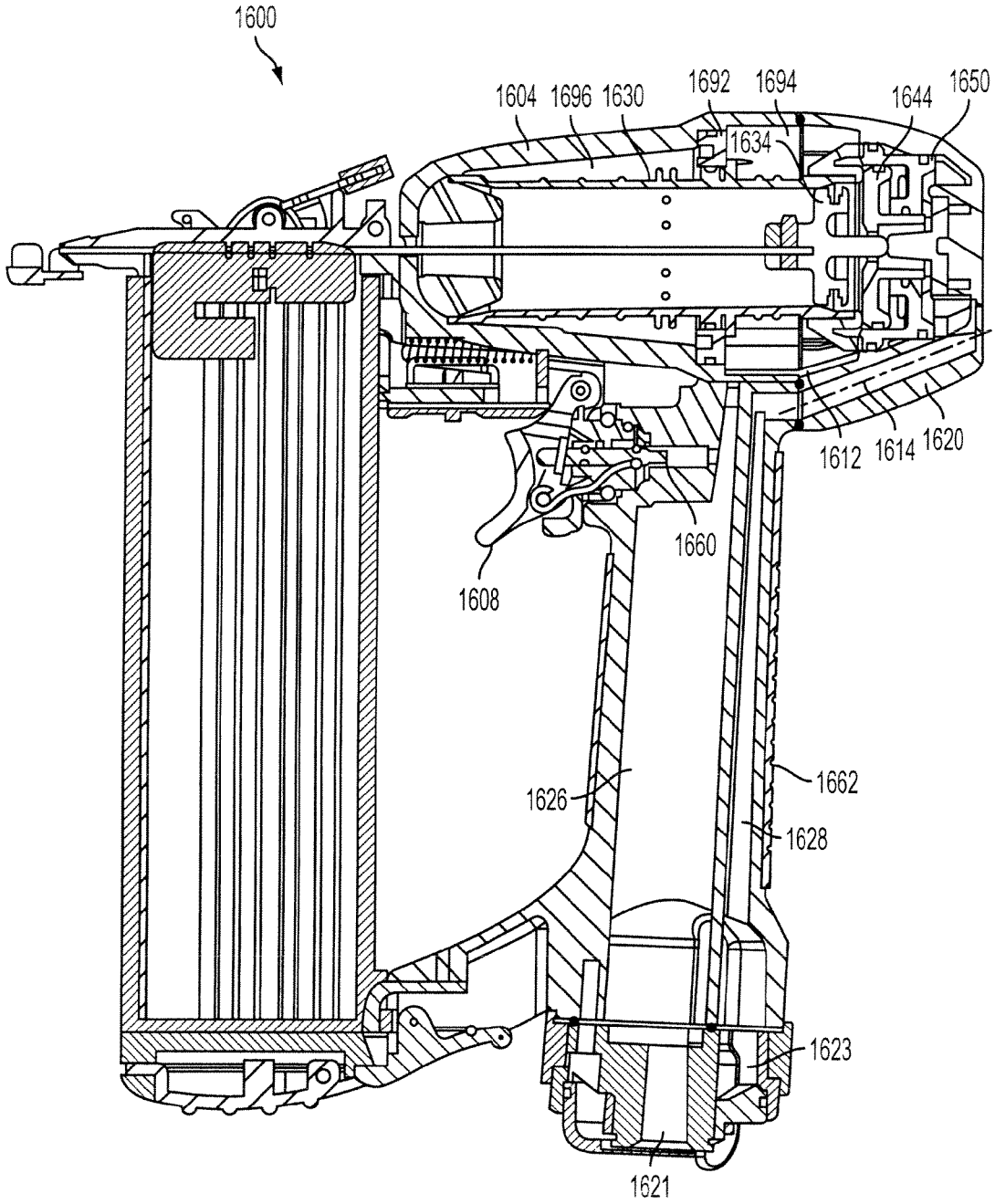
FIG. 16 is a cross-sectional view of an alternative embodiment of a pneumatic fastener.
Figure 17:
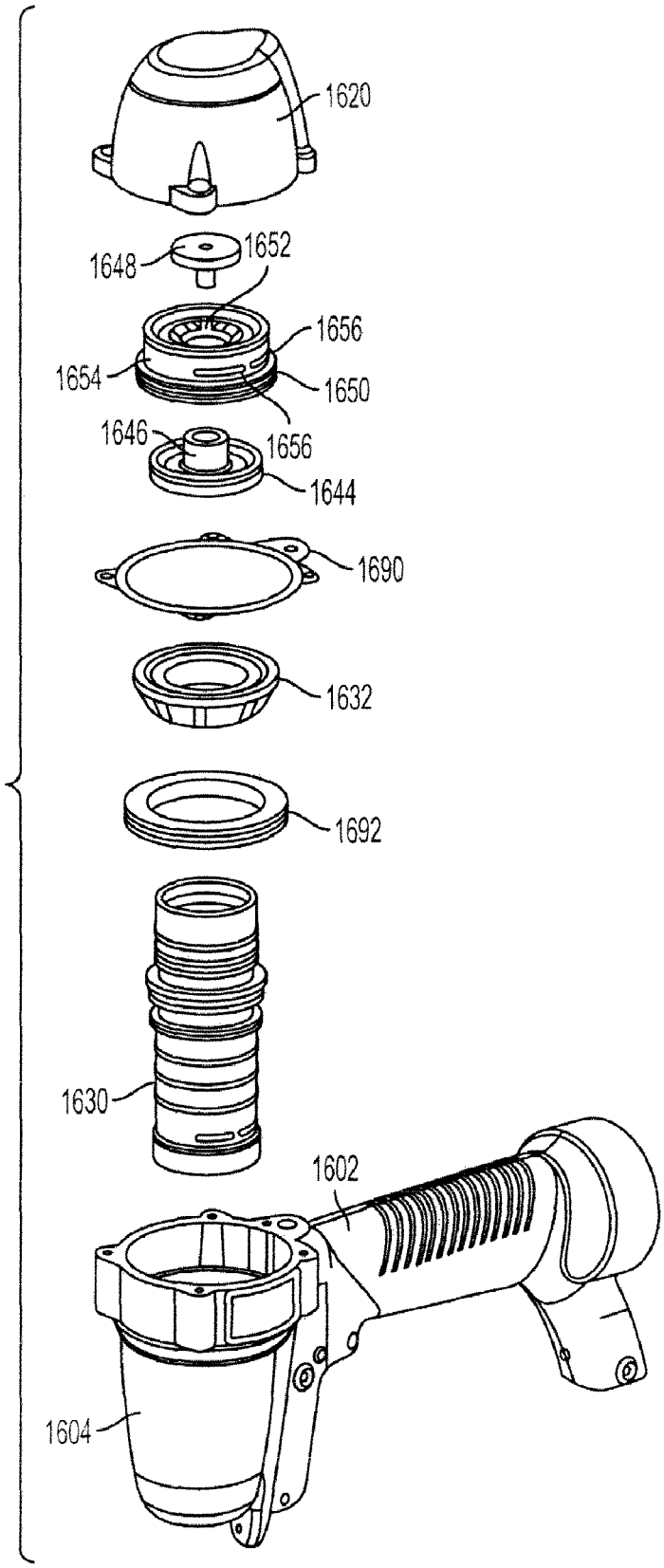
FIG. 17 is a partially exploded view of the pneumatic fastener of FIG. 16.
Figure 18B:
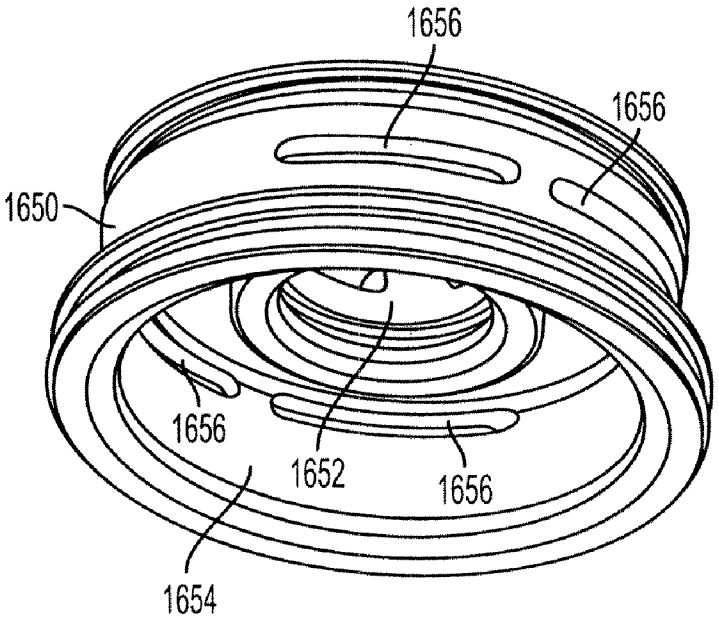
FIGS. 18A and 18B are close-up perspective views of an inner cap of the pneumatic fastener of FIG. 16.
Figure 18A:
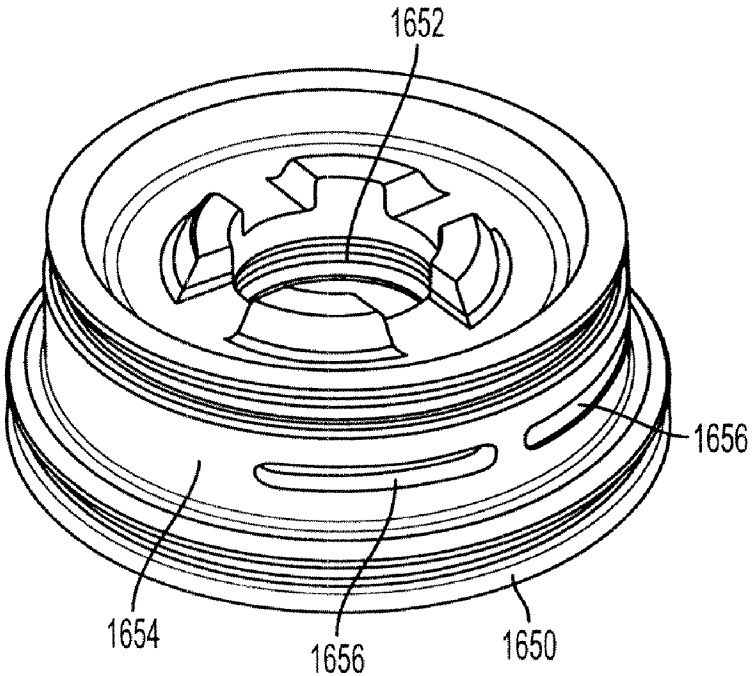

Referring now to FIGS. 14 and 15, an additional embodiment of the present invention is illustrated wherein an adjustable handle exhaust assembly 1400 (see FIGS. 14 and 15) is provided. Such assembly 1400 may be coupled to a second end of a handle of a pneumatic fastener, such as a pneumatic nailer, to replace the handle exhaust 158 and handle adapter 156 as illustrated in FIG. 3. The adjustable handle exhaust assembly 1400 may be used to input compressed air into the inlet channel 126 and may enable an operator to direct the flow of exhaust coming from the outlet channel 128 in a desired direction (e.g., away from the operator). The exhaust assembly 1400 includes a base 1402, which includes a base plate 1404 and a cylindrical and centrally hollow protrusion 1406 protruding from and normal to the base plate 1404. Preferably, the base plate 1404 includes an inlet opening defined therethrough and includes a first portion 1408 and a second portion 1410. Both portions 1408, 1410 have a circular shape and are attached to each other. The first portion 1408 is smaller than the second portion 1410. That is, the diameter of the first portion 1408 is smaller than the diameter of the second portion 1410 so that a perimeter 1412 of the second portion 1410 is exposed for supporting a cap 1414. The base plate 1404 includes a plurality of openings 1416 and an exhaust opening 1418 defined therethrough. A plurality of bolts 1420 may be inserted into the corresponding plurality of openings 1416 to securely couple the base 1402 to the second end 105 of the handle 102 of the pneumatic fastener 100. The protrusion 1406 includes a threaded inner surface defining a channel for receiving a quick connector coupler 1422 and a partially threaded outer surface for receiving a compression ring 1426. The channel defined by the threaded inner surface of the protrusion 1406 is interconnected with the inlet opening of the base plate 1404. The cap 1414 may be made of metal, plastic, rubber, or the like. The cap 1414 includes an exit opening 1424 on its outer surface 1430 for letting the exhaust air exit the pneumatic fastener 100. Preferably, the cap 1414 is donut-shaped with a central hole 1428 defined therein. The cap 1414 is placed on top of the base 1402 so that the protrusion 1406 protrudes from the central hole 1428 and the cap 1414 is supported by the perimeter 1412 of the second portion 1410. Preferably, the cap 1414 is securely coupled to the base 1402 by the compression ring 1426 fastened on the partially threaded outer surface of the protrusion 1406 so that the exhaust inside the cap 1414 may exit to outside through the exit opening 1424. The cap 1414 may be easily rotated to change the position of the exit opening 1424 whereby exhaust air exiting the exit opening 1424 can be directed in a desired direction (e.g., away from an operator).

The adjustable handle exhaust assembly 1400 may be securely coupled to the second end 105 of the handle 102 of the pneumatic fastener 100 by the bolts 1420 to replace the handle adapter 156 and the handle exhaust 158. Preferably, the inlet opening of the base plate 1404 is interconnected with the inlet channel 126, and the exhaust opening 1418 is interconnected with the outlet channel 102. The quick connector coupler 1422 is connected to an air supply hose for supplying compressed air to the pneumatic fastener 100. The compressed air flows from the air supply hose into the inlet channel 126, via the quick connector coupler 1422, the channel defined by the threaded inner surface of the protrusion 1406, and the inlet opening of the base plate 1404. The exhaust in the outlet channel 128 flows into the cap 1414 via the exhaust opening 1418 and exits the cap 1414 via the exit opening 1424. An operator may rotate the cap 1414 easily to change the position of the exit opening 1424 so that the exhaust air exiting the exit opening 1424 is directed in a desired direction (e.g., away from the operator).

In a further exemplary embodiment directed to the present invention, a method of manufacturing a pneumatic fastener, such as the pneumatic fastener 100, is provided. In a first step a housing including a piston assembly is provided. The housing may be of various configurations to support the functional operation of the pneumatic fastener and address aesthetic and/or ergonometric considerations. The housing is further provided with a housing inlet port and a housing exhaust port. The next step involves positioning a handle, including a handle adapter for receiving compressed air and a handle exhaust for exhausting the compressed air, to be coupled with the housing. The handle including an inlet channel coupled with the handle adapter and an outlet channel coupled with the handle exhaust. The inlet channel is further coupled with the housing inlet port and the outlet channel is further coupled with the housing exhaust port. Next, a head valve assembly including an inner cap of the present invention, is established in operational connection with the piston assembly. The inner cap further includes an inner cap inlet conduit which couples with the housing inlet port and an inner cap exhaust conduit which couples with the housing exhaust port. An outer cap is then fastened to the housing, the outer cap at least partially encompassing the head valve assembly and coupling with the inner cap.

It is contemplated that the method manufacturing may further include the establishment of a groove into the outer cap. The groove being enabled to receive an O-ring gasket and for providing a seal between the outer cap and the inner cap. In an alternative embodiment, the method of manufacturing may include the establishment of a groove in the inner cap for receiving an O-ring gasket and establishing a seal between the outer cap and the inner cap.

It is understood that the specific order or hierarchy of steps in the methods disclosed are examples of exemplary approaches. Based upon design preferences, it is understood that the specific order or hierarchy of steps in the method can be rearranged while remaining within the scope and spirit of the present invention.

It is believed that the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. Further, it is to be understood that the claims included below are merely exemplary of the present invention and are not intended to limit the scope of coverage which has been enabled by the written description.

What is claimed is:

1. A pneumatic fastener, comprising:

a housing;

a handle coupled to the housing, the handle defining an inlet channel for delivering compressed gas to the housing;

a trigger valve in communication with the inlet channel and configured to actuate the pneumatic fastener;

a fastener driving assembly disposed within the housing, the fastener driving assembly including a cylinder and a piston that reciprocates within the cylinder to drive a fastener;

a valve piston coupled to the fastener driving assembly, wherein actuation of the valve piston causes compressed air to drive the piston within the cylinder to drive the fastener;

an outer cap coupled to the housing; and an inner cap disposed at least partially within the outer cap, the inner cap including an opening in communication with the trigger valve for porting the compressed air to a region above the valve piston, wherein the opening also ports the compressed air from the region above the valve piston to the trigger valve upon actuation of the trigger valve.

2. The pneumatic fastener of claim 1, wherein the inner cap comprises a sidewall.

3. The pneumatic fastener of claim 2, wherein the opening comprises a plurality of openings in the sidewall.

4. The pneumatic fastener of claim 2, wherein the sidewall comprises a generally cylindrical sidewall.

5. The pneumatic fastener of claim 1, wherein the inner cap is seated in the outer cap with a space between the inner cap and the outer cap. the space being in communication with the inlet channel.

6. The pneumatic fastener of claim 5, wherein the opening is in communication with the space.

7. The pneumatic fastener of claim 6, wherein the space is also in communication with the trigger valve.

8. The pneumatic fastener of claim 1, wherein the inner cap further comprises a central opening configured to transmit exhaust air from the cylinder to an exhaust channel.

9. The pneumatic fastener of claim 8, wherein the exhaust channel is at least partially disposed in the handle.

10. The pneumatic fastener of claim 8, wherein at least a portion of the inlet channel and at least a portion of the exhaust channel are defined in the outer cap.

11. The pneumatic fastener of claim 1, wherein the inner cap and the valve piston are composed of materials that are configured to reduce lubrication needed for movement of the valve piston.

12. The pneumatic fastener of claim 1, wherein the inner cap and the valve piston are composed of materials that are configured to have approximately the same degree of thermal expansion.

13. The pneumatic fastener of claim 1, wherein at least one of the inner cap and the valve piston comprises a lubricious plastic.

14. The pneumatic fastener of claim 1, wherein the valve piston abuts an end portion of the cylinder.

15. The pneumatic fastener of claim 14, wherein when the trigger valve is actuated, the valve piston separates from the cylinder to allow compressed air to enter the cylinder to cause the piston to reciprocate in the cylinder.

16. The pneumatic fastener of claim 1, wherein the cylinder remains stationary when the trigger valve is actuated.

17. A pneumatic fastener comprising:

a housing;

a nosepiece coupled to the housing;

a magazine coupled to one of the nosepiece and the housing and configured to store a plurality of fasteners;

a driver disposed in the nosepiece for driving a fastener that has been dispensed from the magazine into a workpiece;

a trigger coupled to the housing and configured to actuate the driver to drive the fastener;

a fastener driving assembly disposed within the housing, the fastener driving assembly including a cylinder and a piston that reciprocates within the cylinder in response to application of compressed gas to drive the driver;

a valve piston coupled to the fastener driving assembly, wherein actuation of the valve piston causes the compressed gas to drive the piston within the cylinder to drive the fastener;

a handle having a first end portion coupled to the housing and a second end portion coupled to the magazine, the second end portion including an inlet connection for coupling the pneumatic fastener to a source of the compressed gas;

an inlet channel extending through the handle from the inlet connection to the housing to deliver the compressed gas from the inlet connection to the housing;

a trigger valve in communication with the inlet channel and configured to actuate the pneumatic fastener;

an outer cap coupled to the housing; and an inner cap disposed between the outer cap and the valve piston, the inner cap including a generally cylindrical sidewall that defines an axial opening configured to transmit exhaust air from the cylinder to an exhaust channel, and that defines at least one radial opening configured to port compressed gas from the trigger valve to a region above the valve piston before actuation of the trigger and to port compressed gas from the region above the valve piston to the trigger valve upon actuation of the trigger.

18. The pneumatic fastener of claim 17, wherein the inner cap and the valve piston are composed of materials that are configured to reduce lubrication needed for movement of the valve piston.

19. A pneumatic fastener, comprising:

a housing;

a handle coupled to the housing, the handle defining an inlet channel for delivering compressed air to the housing;

a cylinder disposed within the housing;

a piston that reciprocates within the cylinder to drive a fastener;

a trigger valve that is in communication with the inlet channel and that is configured to actuate the pneumatic fastener;

a valve piston moveable between a first position in which the valve piston abuts an end portion of the cylinder and a second position in which the valve piston is separated from the cylinder;

an outer cap coupled to the housing; and an inner cap disposed at least partially within the outer cap and having a generally cylindrical sidewall configured to receive at least a portion of the valve piston, the sidewall defining at least one radial opening in communication with the trigger valve for porting the compressed air to a region above the valve piston, wherein, when the trigger valve is actuated, the compressed air above the valve piston is exhausted to atmosphere, causing the valve piston to separate from the cylinder, which enables compressed air to enter the cylinder and cause the piston to reciprocate in the cylinder.

20. The pneumatic fastener of claim 19, wherein the inner cap is seated in the outer cap with a space between the inner cap and the outer cap, the space being in communication with the inlet channel.

21. The pneumatic fastener of claim 19, wherein the inner cap further comprises a central opening configured to transmit exhaust air from the cylinder to an exhaust channel.

22. The pneumatic fastener of claim 21, wherein the exhaust channel is at least partially disposed in the handle.

23. The pneumatic fastener of claim 21, wherein at least a portion of the inlet channel and at least a portion of the exhaust channel are defined in the outer cap.

24. The pneumatic fastener of claim 19, wherein the inner cap and the valve piston are composed of materials that are configured to reduce lubrication needed for movement of the valve piston.

* * * * *